US010010225B2

(12) United States Patent
Little

(10) Patent No.: US 10,010,225 B2
(45) Date of Patent: Jul. 3, 2018

(54) FOAM FORMULATION AND AEROSOL ASSEMBLY

(71) Applicant: Kokomo Limited, Abingdon, Oxfordshire (GB)

(72) Inventor: Gary Little, Abingdon (GB)

(73) Assignee: Kokomo Limited, Abingdon, Oxfordshire (GB)

( * ) Notice: Subject to any disclaimer, the term of this patent is extended or adjusted under 35 U.S.C. 154(b) by 25 days.

(21) Appl. No.: 15/101,823

(22) PCT Filed: Dec. 3, 2014

(86) PCT No.: PCT/GB2014/053591
§ 371 (c)(1),
(2) Date: Jun. 3, 2016

(87) PCT Pub. No.: WO2015/082918
PCT Pub. Date: Jun. 11, 2015

(65) Prior Publication Data

US 2016/0302624 A1 Oct. 20, 2016

(30) Foreign Application Priority Data

Dec. 5, 2013 (GB) ..... 1321484.6

(51) Int. Cl.

| | |
|---|---|
| ***B67D 7/76*** | (2010.01) |
| ***A47K 5/14*** | (2006.01) |
| ***B65D 83/14*** | (2006.01) |
| ***B65D 83/30*** | (2006.01) |
| ***A47K 5/12*** | (2006.01) |
| ***B65D 83/48*** | (2006.01) |

(52) U.S. Cl.
CPC ..... *A47K 5/14* (2013.01); *A47K 5/1211* (2013.01); *B65D 83/303* (2013.01); *B65D 83/48* (2013.01); *B65D 83/752* (2013.01); *B65D 83/753* (2013.01)

(58) Field of Classification Search
CPC ..... A47K 5/14; A47K 5/1211; B65D 83/303; B65D 83/48; B65D 83/752
USPC ..... 222/190, 402.13
See application file for complete search history.

(56) References Cited

U.S. PATENT DOCUMENTS 3,342,382 A 9/1967 Huling
3,704,725 A * 12/1972 Marand ..... B65D 83/60 137/550
3,788,521 A * 1/1974 Laauwe ..... B65D 83/62 222/94

(Continued)

FOREIGN PATENT DOCUMENTS

JP 2012-224376 A 11/2012
WO WO 2009/100092 A2 8/2009

OTHER PUBLICATIONS

Decision to Grant a Patent and English-language machine translation, Japanese Patent Application No. 2016-533095, dated Aug. 8, 2017, 6 pp.

(Continued)

*Primary Examiner* — Patrick M Buechner
*Assistant Examiner* — Michael J Melaragno
(74) *Attorney, Agent, or Firm* — Myers Bigel, P.A.

(57) ABSTRACT

A foam formulation and an aerosol assembly containing the foam formulation and a propellant where the foam formulation is produced as a shaped foam and/or as a foam that has a density less than that of air.

17 Claims, 21 Drawing Sheets

(56) References Cited

U.S. PATENT DOCUMENTS 3,813,011 A * 5/1974 Harrison ..... B65D 83/20 222/136
3,825,159 A * 7/1974 Laauwe ..... B65D 83/48 222/402.24
3,921,857 A * 11/1975 Riccio ..... B05B 11/06 222/145.5
4,019,657 A * 4/1977 Spitzer ..... B65D 83/14 222/136
4,022,351 A * 5/1977 Wright ..... A45D 27/02 222/190
4,075,265 A * 2/1978 McClung ..... B29C 44/50 264/177.1
4,549,674 A * 10/1985 Alticosalian ..... B65D 83/205 222/135
4,679,706 A * 7/1987 Magid ..... B65D 83/625 222/130
4,932,567 A * 6/1990 Tanabe ..... B05B 7/0062 222/190
5,137,179 A * 8/1992 Stoffel ..... B65D 83/62 215/3
5,167,347 A * 12/1992 Wiegner ..... B65D 83/46 222/136
5,190,184 A * 3/1993 Lechner ..... B65D 83/62 220/255
5,505,039 A * 4/1996 Maier ..... B65B 31/00 141/20
5,730,326 A * 3/1998 Kaeser ..... B65D 83/34 222/402.1
5,799,469 A * 9/1998 Obrist ..... B65D 83/62 53/408
7,021,499 B2 * 4/2006 Hansen ..... A47L 13/00 222/135
7,036,685 B1 * 5/2006 Green ..... B65D 83/303 222/145.6
7,040,507 B2 * 5/2006 Koike ..... A61K 8/046 222/135
8,844,584 B1 * 9/2014 Haley ..... B65B 31/003 141/20
2002/0074357 A1 * 6/2002 Karr ..... B65D 83/207 222/190
2002/0153390 A1 10/2002 Vlodek
2004/0251275 A1 * 12/2004 Sams ..... B65D 81/3211 222/145.6
2005/0274737 A1 * 12/2005 Krause ..... B65D 83/62 222/105
2006/0272537 A1 * 12/2006 Garrett ..... B65D 83/663 102/367
2007/0267437 A1 * 11/2007 Nimmo ..... B65D 83/62 222/95
2008/0314475 A1 * 12/2008 Fransen ..... B65D 83/62 141/20
2009/0193695 A1 * 8/2009 Guerra ..... A63H 33/28 40/212
2009/0198574 A1 * 8/2009 Guerra ..... B29C 44/022 705/14.23
2011/0139810 A1 * 6/2011 Lee ..... B65D 83/44 222/1
2012/0071581 A1 * 3/2012 Sklar ..... C09D 5/14 523/122
2012/0074171 A1 * 3/2012 Quinlan ..... A47K 5/14 222/190
2013/0175306 A1 * 7/2013 Frailey ..... B01F 5/0608 222/402.18
2013/0186911 A1 * 7/2013 Hornland ..... B65D 83/205 222/135
2013/0264400 A1 10/2013 Crandley
2013/0284763 A1 * 10/2013 Banks ..... B01F 5/0478 222/190
2014/0158719 A1 * 6/2014 Davideit ..... B65D 83/48 222/402.2
2014/0361038 A1 * 12/2014 Mekata ..... B65D 83/384 222/95
2015/0108163 A1 * 4/2015 Smith ..... B65D 83/14 222/95
2015/0166253 A1 * 6/2015 Nomura ..... B65B 31/003 222/402.1
2015/0360853 A1 * 12/2015 Nicmanis ..... B05B 7/0025 516/10

OTHER PUBLICATIONS

Response to Notice of Reasons for Rejection and English-language machine translation, Japanese Patent Application No. 2016-533095, dated Jul. 6, 2017, 12 pp.
Notice of Reasons for Rejection and English-language translation, Japanese Patent Application No. 2016-533095, dated May 9, 2017, 6 pp.
Allowed Claims and English-language translation, Japanese Patent Application No. 2016-533095, dated Jul. 15, 2017, 6 pp.
PCT International Search Report and Written Opinion corresponding to International Application No. PCT/GB2014/053591; Date of mailing of the International Search Report and Written Opinion: dated Feb. 13, 2015 (10 pages).

* cited by examiner

FOAM FORMULATION AND AEROSOL ASSEMBLY

RELATED APPLICATIONS

This application is a 35 U.S.C. § 371 national stage application of PCT Application No. PCT/GB2014/053591, filed on Dec. 3, 2014, which claims priority from Great Britain Patent Application No. 1321484.6, filed on Dec. 5, 2013, the contents of which are incorporated herein by reference in their entireties. The above-referenced PCT International Application was published in the English language as International Publication No. WO 2015/082918 A1 on Jun. 11, 2015.

The present invention is directed to a foam formulation and an aerosol assembly for dispensing the foam formulation where the foam formulation is produced as a shaped foam and/or as a foam that has a density less than that of air.

A large range of foam formulations are known including foam soaps and moldable foam soaps. Some of these are typically available in push down dispensers and others in aerosol cans.

The present invention is directed to an aerosol assembly and a foam formulation and a propellant where the foam produced by the assembly either has a defined shape which it maintains for at least 1 second, or has a density which is lower than that of air, or both. In order to provide foam with a defined shape, the aerosol assembly typically may include a cutting mechanism in a cap of the assembly so as to dispense small amounts of a foam for each operation of the actuator. The foam is preferably dispensed in flat shapes.

Accordingly, the present invention provides an aerosol assembly for dispensing foam comprising;

a body;

at least one reservoir located in the body for foam formulation and propellant, each reservoir fluidly connected to an outlet;

a valve mounted to the body and actuatable to open and close the outlet;

a nozzle defining a passageway extending from the valve to shape forming means; and an actuator member for actuating the valve;

wherein the actuator member is arranged to move relative to the body such that;

in a first position the valve is closed;

as the actuator member moves towards a second position the valve is opened;

wherein the shape forming means is operable to impart a cross-sectional shape to the foam as the foam is ejected from the nozzle.

The present invention also provides a cap for mounting on an aerosol assembly, the aerosol assembly comprising a body;

at least one reservoir located in the body for foam formulation and propellant, each reservoir fluidly connected to an outlet;

a valve mounted to the body and actuatable to open and close the outlet;

a nozzle defining a passageway extending from the valve to shape forming means; and an actuator member for actuating the valve;

wherein the actuator member is arranged to move relative to the body such that;

in a first position the valve is closed;

as the actuator member moves towards a second position the valve is opened;

wherein the shape forming means is operable to impart a cross-sectional shape to the foam as the foam is ejected from the nozzle.

The present invention also provides a method of ejecting foam from an aerosol assembly, the method comprising the steps of;

actuating a valve such that foam formulation passes from at least one reservoir and out of a reservoir opening;

shaping the ejected foam by passing the ejected foam through a die opening with a pre-determined cross-sectional shape.

The method may also include the step of cutting a length of the foam passed through the die opening utilising a cutting member positioned adjacent to the die opening.

Preferably, the aerosol assembly in each aspect of the invention is an aerosol can assembly. The can is typically made of lacquered tin or of aluminium. In another embodiment, the aerosol can is a plastic container such as a blow moulded container, preferably a blow moulded bottle. Suitable plastics for the container include PET and PETG. In one embodiment of the present invention, the can contains a layer of sealant on the inside. In addition, some cans are known as bag-in-can or bag-on-valve aerosols where a propellant is separated from the formulation by a bag.

In a preferred embodiment, the actuator member is operable to dispense a metered dose of foam when the actuator member is moved from the first position to the second position.

In a further embodiment, the shape forming means comprises a die having a die opening. The die may be formed of a removable plate and the die opening is formed in the plate.

In one embodiment the plate is held in place on either side by one or more fixing plates.

In another embodiment the shape forming means is formed integrally with the nozzle.

In one embodiment, the assembly produces a shaped foam that maintains its shape. The shaped foam of the present invention typically maintains its shape for at least 1 second, preferably at least 2 seconds, preferably at least 5 seconds, preferably at least 10 seconds, preferably at least 15 seconds, preferably at least 20 seconds, preferably at least 30 seconds, preferably at least 40 seconds, preferably at least 1 minute, preferably at least 2 minutes.

Where the aerosol assembly produces a shaped foam, the propellant can be any known propellant such as propane, butane, isobutane, nitrogen, oxygen or helium or a mixture thereof. Other possible propellants include hydrogen, air (compressed), urethan, ethane and 2-mthyl-propane.

The shape forming means imparts a shape to the foam which is recognisable to the user of the aerosol assembly. When a die is present, the die opening provides the cross-section shape of the shaped foam and the cross-sectional shape may be, for example, a star, square, rectangle, triangle, heart, animal shape, character shape or a company logo. The shape is typically not a circle. The foam formulation is such that the foam is dispensed from the assembly as a constant 'stream' with a cross-section in the shape imparted by the die opening.

In a preferred embodiment, the foam is cut into flat shapes as it exits the cap and this ensures that the user can readily perceive the shape imparted to the foam. In a preferred embodiment, the foam shape is non-circular. The flat shapes are typically between 1 mm and 5 cm thick, for example, the shapes may be 2 mm, 5 mm, 1 cm, 1.5 cm, 2 cm or 3 cm thick.

In a preferred embodiment, the shapes are typically up to 10 cm in diameter, preferably up to 5 cm, more preferably up to 4 cm in diameter.

In one embodiment, the cap comprises more than one die opening that is rotatably mounted with respect to the nozzle such that alternative die openings can be selected by rotating the cap. The alternative die openings can be the same or different either in size and/or shape. In one embodiment the cap rotates automatically and a new die opening is selected each time that the actuator part is depressed.

The aerosol assembly may also comprise a cutting member actuatable by the actuator member, wherein as the actuator moves between the first position and the second position the cutting member slides adjacent to and across the shape forming means.

In a particularly preferred embodiment the cutting member severs the foam such that the foam shapes have a thickness of up to 30 mm, preferably up to 25 mm, preferably up to or about 2 cm, preferably up to or about 1 cm, most preferably up to or about 5 mm.

In a preferred embodiment the propellant is chosen such that when dispensed the foam has a density less than that of air.

For foam with a density less than that of air, the propellant is any gas or mixture of gases that has a density less than that of air. Typically the gas or gas mixture comprises helium and/or hydrogen optionally mixed with one or more of air, nitrogen, oxygen, propane, methane, ethane, butane or 2-methyl-propane, for example, helium, a helium/oxygen mixture, a helium/nitrogen mixture, hydrogen, a hydrogen/oxygen mixture, or a hydrogen/nitrogen mixture.

The density of air at 20° C. is 1.20 $kgm^{-3}$. Typically, the foam of the present invention would have a density of less than 1.14 $kgm^{-3}$ so as to float in air up to 35° C. In a particularly preferred embodiment, the density of the foam is from 1.135 to 1.19 $kgm^{-3}$ in order that the foam rises slowly at room temperature.

For the purposes of the present invention, the foam of the present invention is regarded as having a density lower than that of air if it rises or floats in air at a temperature of from 0 to 35° C., preferably at a temperature of from 5 to 30° C., more preferably 10 to 25° C. and most preferably at a temperature of from 15 to 25° C. or 15 to 20° C. Thus, the foam may have a density of, for example, less than 1.29, preferably less than 1.27, more preferably less than 1.25, more preferably less than 1.23, more preferably less than 1.20, more preferably less than 1.18, more preferably less than 1.16, more preferably less than 1.14 $kgm^{-3}$.

In one embodiment, the aerosol assembly of the present invention is in the form of a bag-in-can type aerosol can. The bag contains at least one of the foam formulation and a propellant. The can may also contain a further propellant. For the embodiment where the foam has a lower density than that of air, the bag contains a mixture of foam formulation and propellant such that the foam expelled from the can has a low density. The remaining volume inside the aerosol can is filled with a further propellant which remains in the can and is merely used to expel the contents of the bag.

In one embodiment, the at least one reservoir comprises a first reservoir for the foam formulation and a second reservoir for the propellant. Alternatively, the at least one reservoir may be a single reservoir containing the foam formulation and the propellant.

The aerosol assembly may further comprise a mesh screen between the nozzle and the shape forming means.

The aerosol assembly may comprise a porous material between the nozzle and the shape forming means.

The present invention also provides a foam formulation suitable for forming the foam dispensed from an aerosol, preferably an aerosol assembly as defined above. Typically the foam maintains a defined shape when dispensed or has a density lighter than air and, in a preferred embodiment, the dispensed foam is a shaped foam that has a density lower than that of air. Where the foam has a defined shape, it maintains the defined shape for at least one second.

The shaped foam of the present invention typically maintains its shape for at least 1 second, preferably at least 2 seconds, preferably at least 5 seconds, preferably at least 10 seconds, preferably at least 15 seconds, preferably at least 20 seconds, preferably at least 30 seconds, preferably at least 40 seconds, preferably at least 1 minute, preferably at least 2 minutes.

The present invention also provides a foam obtainable from an aerosol assembly as defined above, for example, by dispensing the foam formulation described above. In one embodiment, the foam has a density lower than that of air. When this foam is dispensed from an aerosol assembly, it rises in air due to its low density.

The foam of the present invention, wherein the foam has a density lower than that of air, is any foam that traps sufficient suitable propellant in order to enable it to rise in air.

In a further embodiment, the foam maintains the shape imparted upon it by the shape forming means for at least one second.

In a preferred embodiment, the present invention is directed to a shaped foam, wherein the foam has a density that is lower than that of air.

The density of air at 20° C. is 1.20 $kgm^{-3}$. Typically, the foam of the present invention would have a density of less than 1.14 $kgm^{-3}$ so as to float in air up to 35° C. In a particularly preferred embodiment, the density of the foam is from 1.135 to 1.19 $kgm^{-3}$ in order that the foam rises slowly at room temperature.

For the purposes of the present invention, the foam of the present invention is regarded as having a density lower than that of air if it rises or floats in air at a temperature of from 0 to 35° C., preferably at a temperature of from 5 to 30° C., more preferably 10 to 25° C. and most preferably at a temperature of from 15 to 25° C. or 15 to 20° C. Thus, the foam may have a density of for example, less than 1.29, preferably less than 1.27, more preferably less than 1.25, more preferably less than 1.23, more preferably less than 1.20, more preferably less than 1.18, more preferably less than 1.16, more preferably less than 1.14 $kgm^{-3}$.

A typical foam formulation of the present invention comprises liquid soap and water and may additionally contain one or more preservatives, colours and perfumes. The foam formulation may optionally comprise a pigment and/or a polymer.

Other foam formulations may comprise, for example, a resin and a surfactant and may be used in the present invention. Such a foam formulation may also contain a silicone liquid, plasticiser, flame retardant and a pigment.

The liquid soap used in the present invention typically comprises at least one surfactant. In a preferred embodiment, the liquid soap comprises at least two surfactants. The surfactants may be anionic surfactants, zwitterionic surfactants, betaines, amphoteric surfactants or non-ionic surfactants.

Typical anionic surfactants may be alkali metal salts of organic reactions with sulphuric acid and comprise an alkyl radical of from 8-22 carbon atoms and a sulphuric or sulphonic acid ester radical. Suitable anionic surfactants include sodium lauryl ether sulphate (SLES), ammonium lauryl sulphate; sodium trideceth sulphate; disodium lauryl sulphosuccinate; diammonium lauryl sulphosuccinate; diamyl ester of sodium sulphosuccinic acid; dihexyl ester of sodium sulphosuccinic acid; and dioctyl esters of sodium sulphosuccinic acid, alkyl phosphate esters, ethoxylated alkyl phosphate esters, and combinations thereof.

Typical zwitterionic surfactants may be derivatives of aliphatic quaternary ammonium, phosphonium and sulphonium compounds where the aliphatic chain is from 8 to 18 carbons and may be branched or straight. Suitable zwitterionic surfactants include 4-[N,N-di(2-hydroxyethyl)-N-octadecylammonio]-butane-1-carboxylate; 3-[N,N-dipropyl-N-3-dodecoxy-2-hydroxypropylammonio]-propane-1-phosphonate; and 3-(N,N-dimethyl-N-hexadecylammonio) propane-1-sulfonate and combinations thereof.

Typical betaines include high alkyl betaines, sulphobetaines, amido betaines and amidosulfobetaines. Suitable betaines include coco dimethyl carboxymethyl betaine, lauryl dimethyl carboxymethyl betaine, lauryl dimethyl alpha-carboxy-ethyl betaine, coco dimethyl sulfopropyl betaine, stearyl dimethyl sulphopropyl betaine, and cocamidopropyl betaine or mixtures thereof.

Typical amphoteric surfactants include derivatives of aliphatic secondary and tertiary amines in which the aliphatic radical can be straight chain or branched and wherein one of the aliphatic substituents contains from about 8 to about 18 carbon atoms and one substituent contains an anionic water solubilizing group, e.g., carboxy, sulphonate, sulphate, phosphate, or phosphonate.

Typical non-ionic surfactants are compounds produced by the condensation of alkylene oxide groups (hydrophilic in nature) with an organic hydrophobic compound, which may be aliphatic or alkyl aromatic in nature.

In a preferred embodiment, the soap formulation of the present invention comprises anionic surfactants and/or amido betaine surfactants. In a particularly preferred embodiment, the surfactants comprise alkyl sulfates, ethoxylated alkyl sulfates and mixtures thereof.

Typical emulsifiers or surfactants which may be used in a foam formulation also include sodium laureth sulphate, disodium PEG-8 glyceryl caprylate or caprate, PEG-75 lanolin, polysorbate, triethanolamine, stearic acid, laureth-23, laureth 4 and potassium stearate.

In a preferred embodiment, the soap formulation also includes a polymer or mixture of polymers. In one embodiment the polymer may be chosen from cellulose derivatives or modified cellulose polymers, vinyl polymers, organic or natural gums, microbiological polymers, starch based polymers, acid-based polymers or acrylate polymers. Typical cellulose derivatives or modified cellulose polymers include cellulose, methyl cellulose, ethyl cellulose, hydroxyethyl cellulose, hydroxypropyl methyl cellulose and nitro cellulose. Typical vinyl polymers include polyvinylpyrrolidone and polyvinyl alcohol. Typical organic or natural gums include guar gum, hydroxypropyl guar gum, xanthan gum, arabia gum, tragacanth, galactan, carob gum, guar gum, karaya gum, carrageenan, pectin and agar. Typical microbiological polymers include dextran, succinoglucan and pulleran. Typical starch-based polymers include rice starch, corn starch, potato starch, carboxymethyl starch and methylhydroxypropyl starch. Typical acid-based polymers include sodium alginate and alginic acid propylene glycol esters. Typical acrylate polymers include sodium polyacrylate, polyethylacrylate, polyacrylamide and polyethyleneimine.

The soap formulation may also include an inorganic water soluble material such as bentonite, aluminium magnesium silicate, laponite, hectonite or anhydrous silicic acid.

In a preferred embodiment, the soap formulation includes a drying agent. Typical drying agents include alcohols and volatile silicones. The alcohol may be chosen from, for example, ethanol, methanol, isopropyl alcohol or a denatured alcohol such as denatured ethanol. The volatile silicone may be, for example, a polydimethylsiloxane or a cyclosiloxane.

In a particularly preferred embodiment, the soap formulation comprises one or more surfactants, a drying agent and/or a polymer. In a particularly preferred embodiment, the soap formulation comprises one or more surfactants, a drying agent and a polymer.

Typical preservatives include methylisothiazolinone, DMDM hydantoin and piroctone olamine. Other preservatives that may be used include phenoxyethanol in conjunction with a one or more of parabens such as ethyl paraben, methyl paraben, butyl paraben and propyl paraben, or bronopol (2-bromo-2-nitropropane-1,3-diol).

The soap formulation may also include a foam booster such as glycerine. In another embodiment a film former such as Epitex 66 may be included.

Solvents such as glycerin may be used. Other ingredients may include allantoin, hydroxyethylcellulose, linalool, PEG-7M, maltodextrin, chamomilla recutita flower extract, tocophenyl acetate, BHT and sorbitol.

The foam formulation typically comprises from 75% to 95% water, more preferably from 80% to 90% water, most preferably about 90% water. The foam formulation may comprise from 1 to 70% of drying agent.

Embodiments of the invention will now be described, by way of example only, with reference to, and as show in, the accompanying drawings in which.

According to one aspect, the invention generally relates to an aerosol can assembly comprising an aerosol can, a valve and a cap. The aerosol can defines a reservoir for receiving fluid. The fluid preferably comprises a foam formulation and a propellant. The valve provides means for opening and closing an outlet from the reservoir. The cap is arranged to control the valve and includes a cutting mechanism such that a small portion of a foam is dispensed during each operation of the valve actuator.

Figure 1:
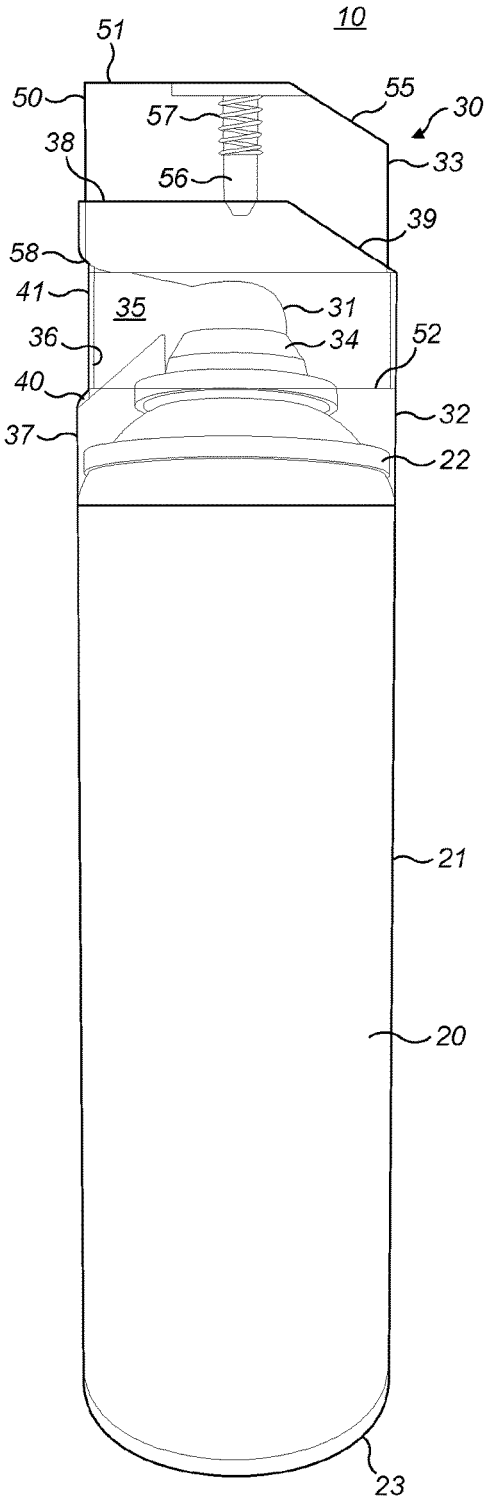
FIG. 1 is a side elevation of an aerosol can assembly of the present invention showing the internal parts of a cap of the aerosol can assembly.

In the embodiment shown in FIG. 1 the can assembly 10 comprises an aerosol can 20, a valve (not shown in full) and a cap 30. The aerosol can 20 may be of the three-piece type, which comprises a substantially cylindrical body 21. The body 21 has a base 23 and an upper end 22 which defines an opening in which is located the valve. An enclosed interior volume is thereby formed within the aerosol can 20. The aerosol can 20 is typically made of lacquered tin or of aluminium.

In alternative embodiments the body 21 may be shaped and/or sized to provide an aerosol can 20 of a different shape, as is known in the art. The body 21 is preferably formed as a single piece.

A reservoir for receiving the foam formulation and propellant is located in the interior volume of the aerosol can 20. The valve is actuatable to control the flow of foam formulation and/or propellant out of the reservoir and the aerosol can 20.

The aerosol can 20 is preferably of the bag-in-can type known in the art, in which the reservoir comprises a sealed bag (not shown) located within the interior volume of the aerosol can 20. In this embodiment, the bag contains the foam formulation and a primary propellant. A secondary propellant is provided between the exterior of the bag and the inner walls of the body 21. The secondary propellant is provided at a higher pressure than atmospheric pressure. Therefore, the secondary propellant applies pressure to the exterior of the bag to force the fluid and propellant out of the reservoir when the valve is opened.

Alternatively, the aerosol can 20 may be of any other suitable type known in the art. In another embodiment the aerosol can 20 is of the basic type in which the reservoir is formed by the interior volume of the aerosol can 20.

Preferably a layer of sealant is provided on the inner walls of the body 21 to ensure that the interior volume of the aerosol can 20 remains sealed.

The valve preferably comprises a slidable valve pin that is depressible to open the valve to eject propellant and/or foam formulation from the reservoir outlet. A resilient bias mechanism, such as a spring, provides a biasing force that biases the valve to the closed position. Therefore, the valve remains closed unless the valve pin is depressed. Alternatively, the valve may be formed in any other suitable arrangement known in the art.

Figure 2:
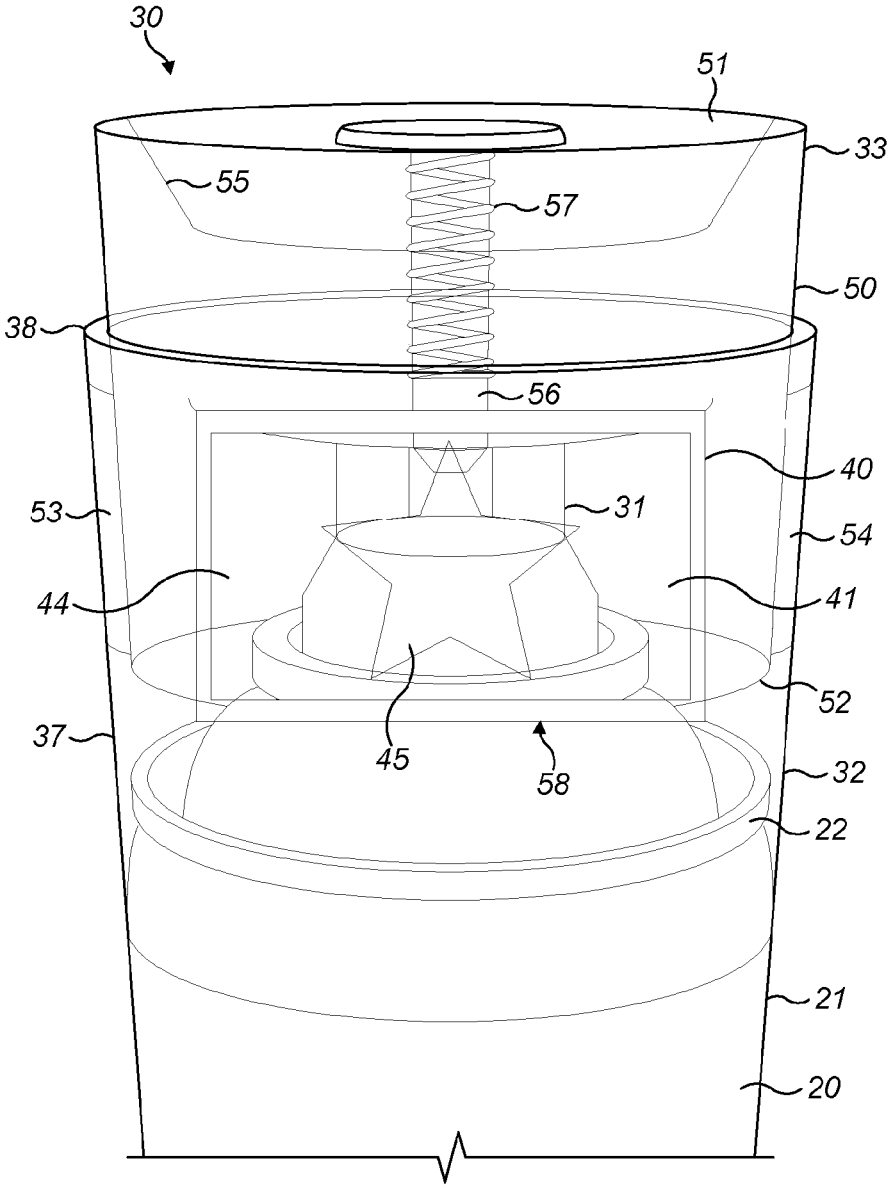
FIG. 2 is a front elevation of an upper section of the aerosol can assembly of FIG. 1 showing the internal parts of the cap.
Figure 3:
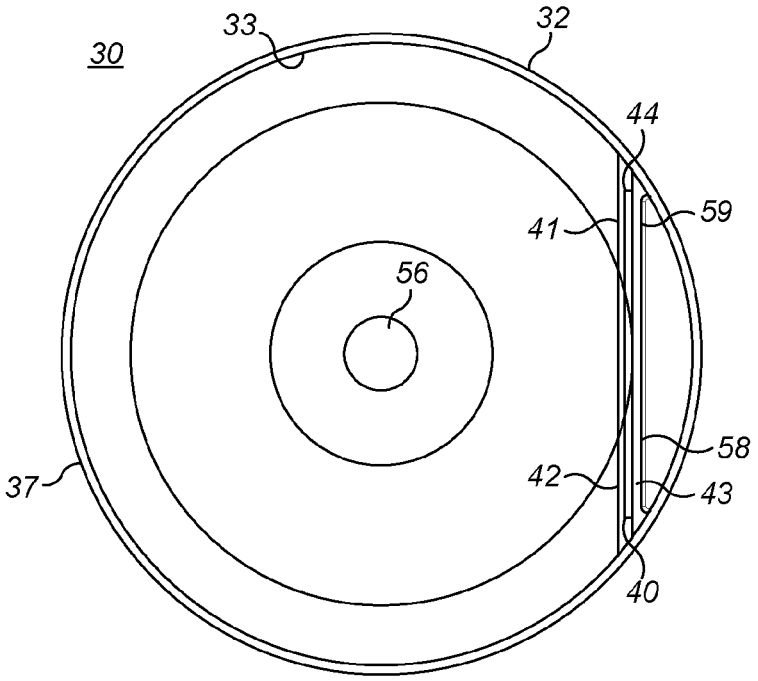
FIG. 3 is a plan view of the underside of the cap of FIGS. 1 and 2 with a nozzle of the cap hidden.
Figure 4:
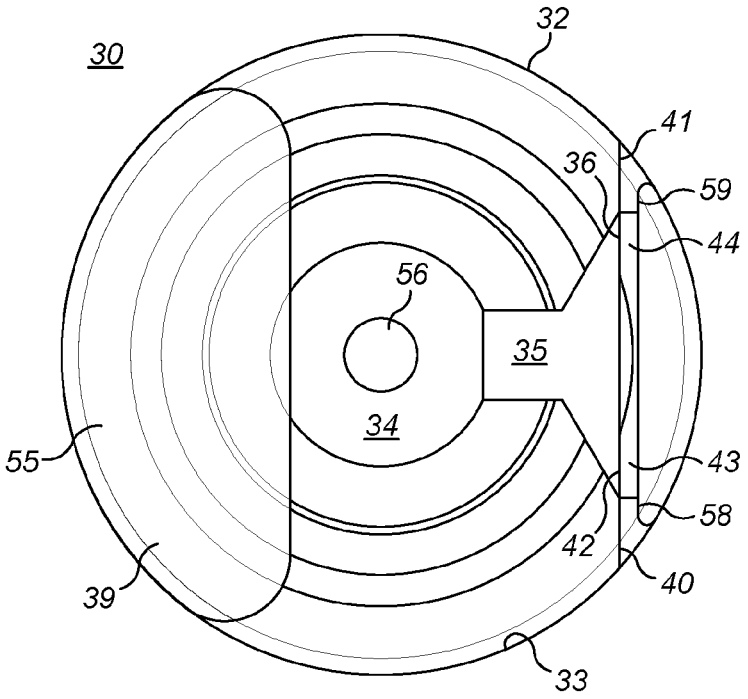
FIG. 4 is a plan view of the top side of the cap of FIGS. 1 to 3 showing the internal parts of the cap.

As illustrated in detail in FIGS. 2, 3 and 4, the cap 30 comprises a nozzle 31, a die part 32 and an actuating member 33. The nozzle 31 acts as an actuator for the operation of the valve. The nozzle 31 is mounted on the aerosol can 30 in a manner which allows it to be depressed towards the can base 22. The nozzle 31 is attached to the valve and engaged with the valve pin. The nozzle 31 is biased away from the can base 22 by the resilient bias mechanism in the valve.

The nozzle 31 comprises a hollow body 34, a lower end of which locates over the valve, with a spout 35 extending radially outwards from the body 34. At a distal end of the spout 35 is a nozzle opening 36. The body 34 and spout 35 define an internal passageway (not shown) extending from the valve/reservoir outlet to the nozzle opening 36. The internal passageway directs foam formulation and/or propellant from the reservoir to the nozzle opening 36 when the valve is actuated.

The internal cross sectional area of the spout 35 is greater at the nozzle opening 36 than at its point of attachment to the body 34. Therefore, the cross-sectional area of the nozzle opening 36 is larger than the cross-sectional area of the internal passageway in the body 34 and valve. Although it is rectangular in this particular embodiment, the nozzle opening 36 may be of any shape.

The die part 32 provides the means for attaching the cap 30 to the aerosol can 20. As shown in FIGS. 1 and 2, the die part 32 is attached at the outside of the main body 21 to an upper end of the aerosol can 20. The die part 32 is preferably attached by adhesive, although other attachment means may be used, such as snap-fitting or engaged threads.

The die part 32 comprises a substantially cylindrical wall 37. As shown in FIG. 2, one end of the wall 37 encircles part of the can body 21 and the other end 38 is open. The open end 38 is provided with a partial cut-away 39 at an oblique angle to the wall 37.

The wall 37 further comprises a recess 40 having a recess opening 41 adjacent to, and of substantially the same size as, the nozzle opening 36. Two annular fixing plates 42, 43 extend around the periphery of the recess opening 41. A die 44, formed as a plate, is positioned between the fixing plates 42, 43 and therefore substantially covers the recess opening 41.

The die 44 further comprises a die opening 45, with an opening area smaller than that of the nozzle opening 36, shown in this embodiment as a star shape. In other embodiments the die opening 45 may be in the shape of, for example, a square, a rectangle, a triangle, a heart, an animal, a character or a company logo. The die shape is typically not circular. The shape is typically recognisable to the user of the aerosol can assembly 10. In a preferred embodiment, the die 44 comprises at least one edge that projects into the die opening 45 such that the die opening has at least one concave edge.

The die 44 is removable from between the fixing plates 42, 43 such that different dies 44 with different shaped die openings 45 can be used. In an alternative embodiment the die 44 is formed integrally with the nozzle 31 such that the nozzle opening 36 and die opening 45 are the same.

The actuating member 33 enables foam exiting the die opening 45 to be cut into discrete portions and for actuating the nozzle 31, thereby actuating the valve. The actuating member 33 comprises a substantially cylindrical side wall 50 closed at one end by an end wall 51 and open at the other end 52. The outer diameter of the side wall 50 is substantially similar to the inner diameter of the die part wall 37, such that the actuating member 33 is slidably received inside the die part 32. The actuating member side wall 50 is attached to the die part wall 37 by suitable attachment means 53, 54. In the embodiment shown, the attachment means 53, 54 comprise two springs biasing the actuator member 33 out of the die part 32.

The end wall 51 comprises an angled portion 55, which is at an oblique angle to the side wall 50. This provides a convenient location for a user's finger to operate the aerosol. The angled portion 55 may include friction improving means (not shown), such as grooves, to provide improved grip to a user. The angled portion 55 is complementary to the partial cut-away 39 of the die part 32.

The actuator member 33 further comprises an actuating pin 56 attached by a spring 57 to the inside of the end wall 51. The pin 56 is located in substantially the centre of the end wall 51 such that the pin 56 is in axial alignment with the body 34 of the nozzle 31 and the valve. The spring 57 biases the pin 56 towards the nozzle 31.

A cutting member 58 is provided by part of the lower edge of the actuator part wall 50 adjacent to the recess opening 41. In the embodiment shown, the cutting member 58 is provided by the edge of a concave recess 59 in the actuator part wall 50 that is complementary to the concave recess 40 of the die part wall 37.

In use, the actuator member 33 is depressed by a user against the biasing force of the attachment means 53, 54. The pin 56 contacts the top of the nozzle body 34 and, as the actuator member 33 is pressed down further, the nozzle 31 is actuated. The valve opens and foam formulation and/or propellant is ejected from the reservoir and travels along the internal passageway of the nozzle 31 as a foam. The foam passes through the die opening 45, which imparts a cross-sectional star shape on the foam. As the actuator part 33 is pressed down further the cutting member 58 severs a portion of the foam ejected from the die opening 45. When the actuator part 33 is released, the attachment means 53, 54 bias the actuator part 33 away from the nozzle 31, thereby closing the valve.

Figure 5:
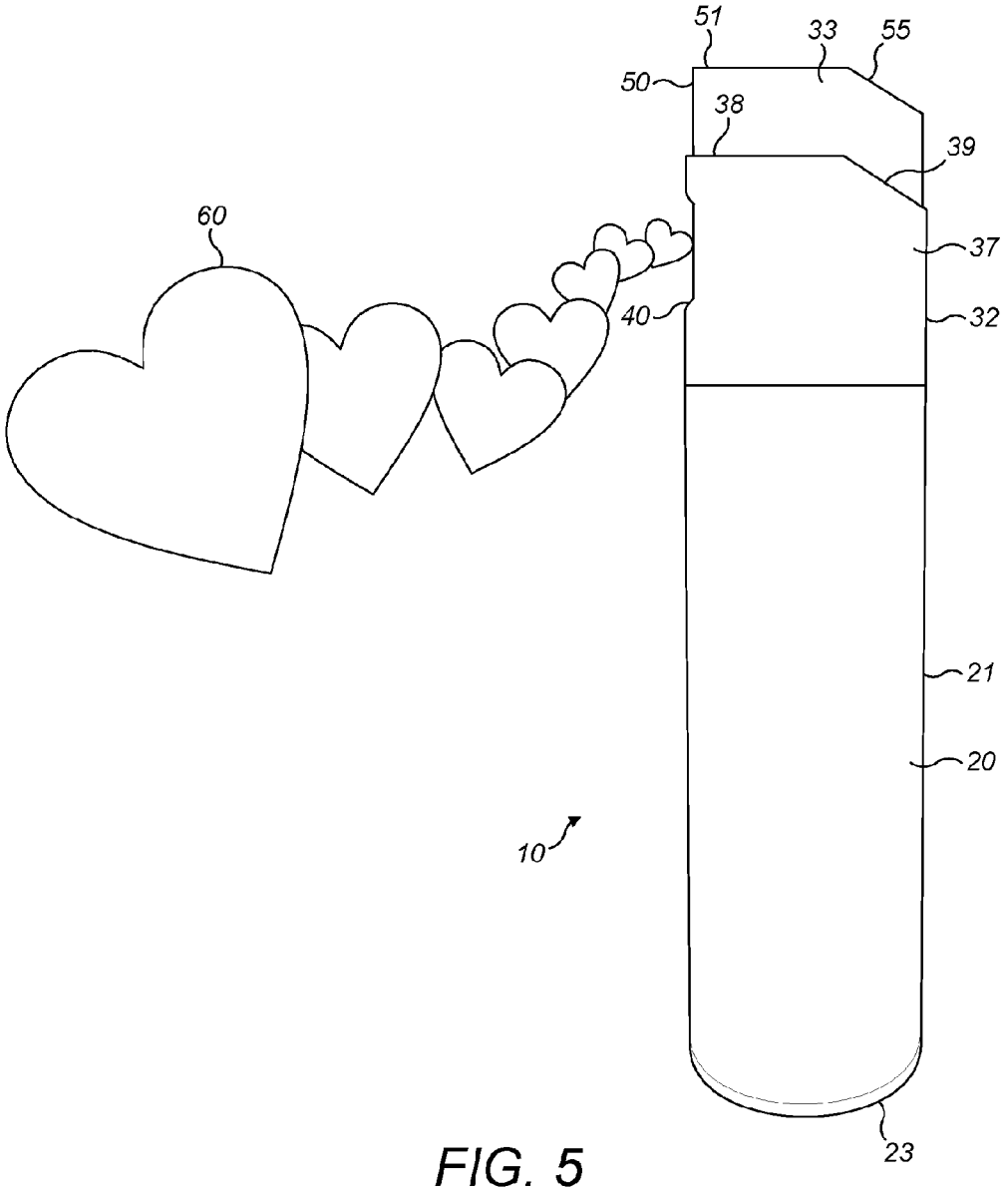
FIG. 5 is a side elevation of an aerosol can assembly of the present invention during use.

As shown in FIG. 5, a shaped foam portion 60, in this embodiment in a heart shape, is thereby ejected from the aerosol can assembly 10. The shape of the foam portion 60 will replicate the shape of the die opening 45 and is typically recognisable to the user of the aerosol can assembly 10. The cutting member 58 severs the foam such that the foam portion 60 has, for example, a thickness of about 2 cm, 1 cm or 5 mm.

In an alternative embodiment, the die part 32 is fixedly attached to the aerosol can 20. The actuating pin 56 may extend through the die part 32 to engage directly with the valve.

In another embodiment the die 44 is attached to the nozzle 31. In such an arrangement, provided that the actuator part 33 is moveably attached to the aerosol can 20, the die part 32 is not necessary.

In yet other embodiments, the cutting member 58 is arranged to cut the ejected foam when the actuator member 33 is released, rather than when the actuator member 33 is depressed as previously described. In one embodiment, a cutting opening is formed in the actuator member 33 adjacent to the die opening 45. Foam is only ejected when the actuator member 33 is fully depressed through the die opening and the cutting opening. When the actuator member 33 is released, the lower edge of the cutting opening will cut away a portion of the ejected foam as the actuator member 33 moves away from the aerosol can 20.

In a further embodiment, the die part 32 comprises more than one die opening 45 and is rotatably mounted to the aerosol can 20 with respect to nozzle 31. Alternative die openings 45 can be selected by rotating the die part 32 such that different die openings 45 overlie the nozzle opening 36. The alternative die openings 45 are the same or different either in size and/or shape. In one embodiment the die part 31 rotates automatically and a new die opening 45 is selected each time the actuator part 33 is depressed.

Other embodiments of aerosol assemblies are shown in FIGS. 6-20.

Figure 6:
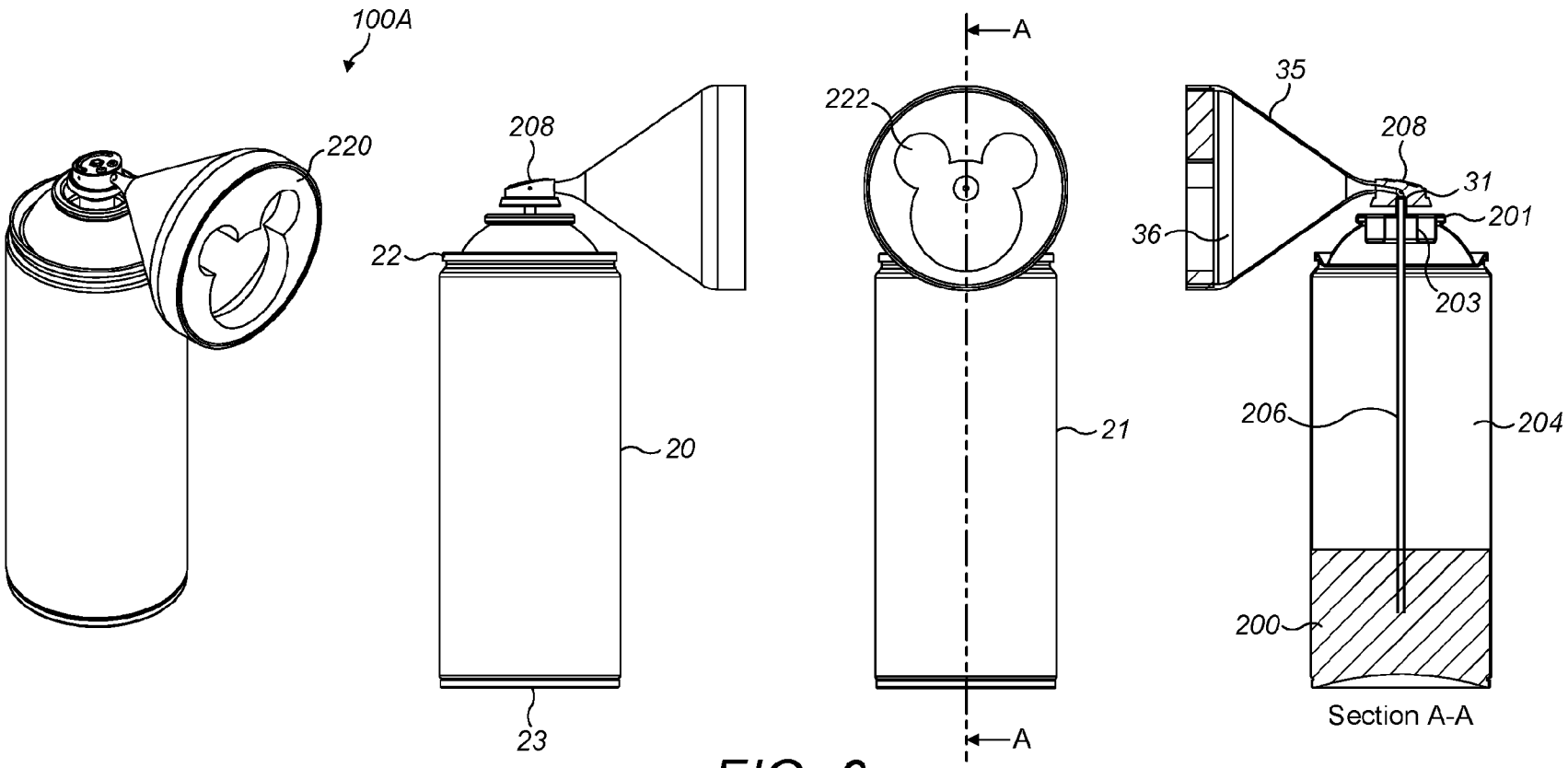
FIG. 6 shows various views of a second embodiment of aerosol can assembly.

One embodiment 100A of aerosol assembly is shown in FIG. 6. The embodiment includes an aerosol can 20 defining a substantially cylindrical body 21. The body 21 has a base 23 and an upper end 22 which defines an opening 201 in which is located a valve portion 203 containing a valve (not shown). An enclosed interior volume is formed within the aerosol can 20 defining a reservoir containing a liquid foam formulation 200 and a gaseous propellant 204.

A tube 206 extends from the valve portion 203 in the upper end 22 downwardly into the interior volume of the can 20 and into the liquid foam formulation 200.

An actuator member 208 is connected to the valve portion 203 and is moveable in a manner which allows it to be depressed towards the valve portion 203 to open the valve contained therein. The actuator member 208 is biased away from the valve portion 203 by a resilient bias mechanism (not shown) located in the valve portion 203.

A nozzle 31 is located in the actuator member 208. The nozzle 31 comprises a lower end of which is fluidly connected to the valve located in the valve portion 203, with a spout 35 extending radially outwards from the actuator member 208. At a distal end of the spout 35 is a nozzle opening 36. The nozzle 31 and spout 35 define an internal passageway extending from the valve/reservoir outlet to the nozzle opening 36. The internal passageway directs foam formulation and propellant from the reservoir to the nozzle opening 36 when the valve is actuated.

The internal cross sectional area of the spout 35 is greater at the nozzle opening 36 than at its point of attachment to the actuator member 208. Therefore, the cross-sectional area of the nozzle opening 36 is larger than the cross-sectional area of the portion of the internal passageway in the actuator member 208.

The nozzle opening 36 receives a shape forming means 220 in the form of a die containing an opening 222 with a particular cross section. As shown in FIG. 6, the opening 22 is mouse head shaped.

To operate the aerosol assembly shown in FIG. 6, the actuator member 208 is depressed downwardly by a user against the biasing force of the resilient bias mechanism (not shown) located in the valve portion 203. As the actuator member 208 is pressed down further, the valve in the valve portion 203 opens and foam formulation and/or propellant is ejected from the reservoir and travels up the tube 206 via the Venturi effect, through the valve, through the spout 35 of the nozzle 31 and out of the opening 222 located in the shape forming means 220. As the foam travels through the opening 222, the opening 222 imparts a cross-sectional shape on the foam.

Foam will continue to be emitted from the assembly via the opening 222 until the downward force applied to the actuator member 208 is released.

In the case of a foam with a low enough density, once the downward force applied to the actuator member 208 is released, the up thrust force generated by the emitted foam, which is still attached to the shape forming means 220, overcomes the frictional force between the foam and the shape forming means such that the foam is torn from the opening 222 and away from the assembly 100A.

Irrespective of the density of the foam used, the emitted foam can at any time be separated from the shape forming means 220 by the user sweeping their finger across the opening 222 of the shape forming means 220. Alternatively, a cutting means (not shown in FIG. 6) can be attached to the shape forming means 220 to sever the foam emitted from the opening 222.

Figure 12:
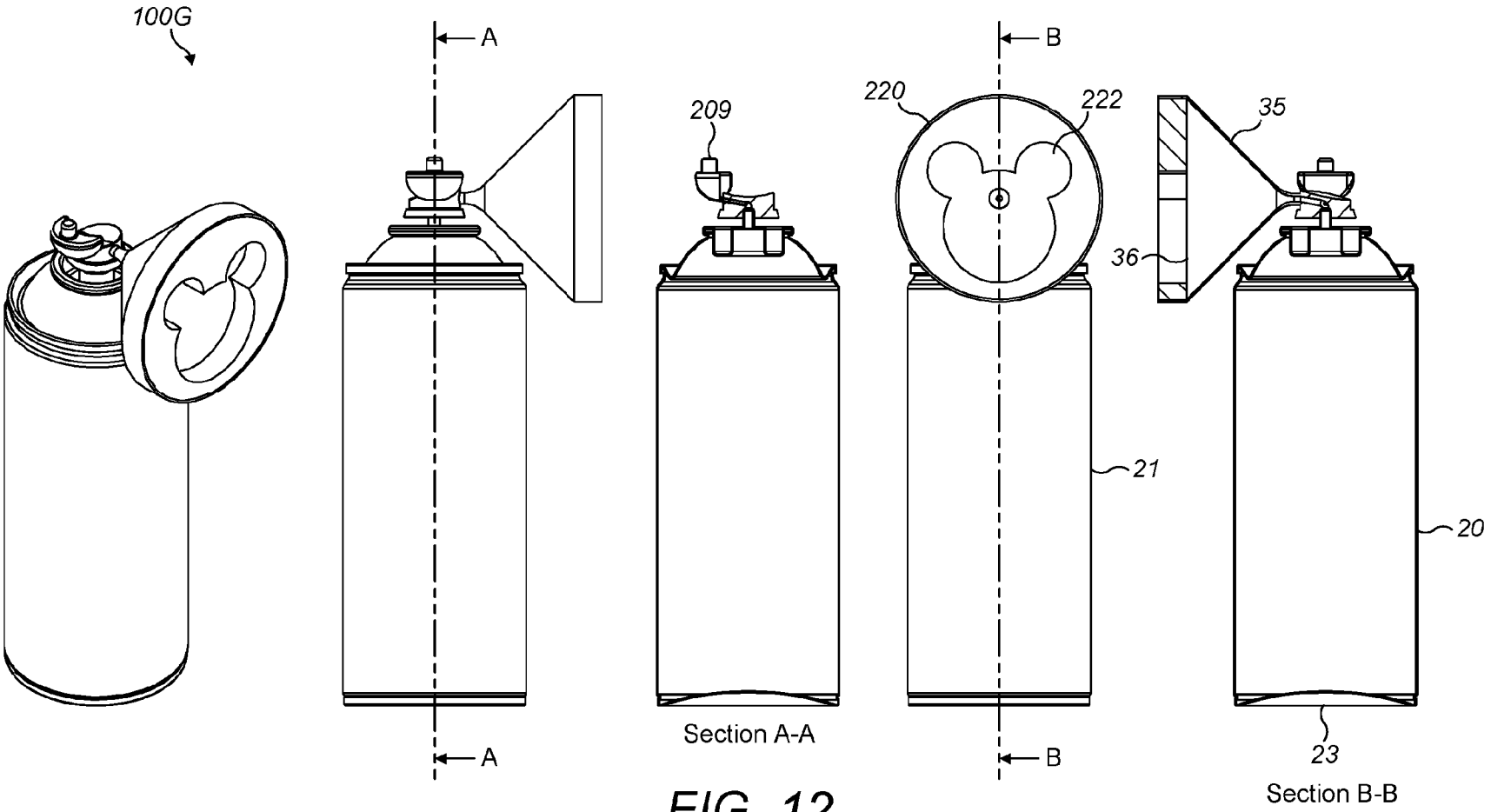
FIG. 12 shows an eighth embodiment of aerosol can assembly.

An alternative embodiment 100G to the aerosol can assembly of FIG. 6 is shown in FIG. 12. In this embodiment, rather than being located in the interior volume of the can 20, the liquid foam formulation 200 is fluidly connected from an external source (not shown) to an access port 209 located on the actuator member 208. The access port 209 defines a fluid channel which, when the valve of the valve portion 203 is actuated by the actuator member 208, allows liquid foam formulation contained in the external source to enter the actuator member 208 and be entrained with the emitted propellant from the can 20 to form the foam which is emitted from the opening 222 of the shape forming means 220.

Figure 7A:
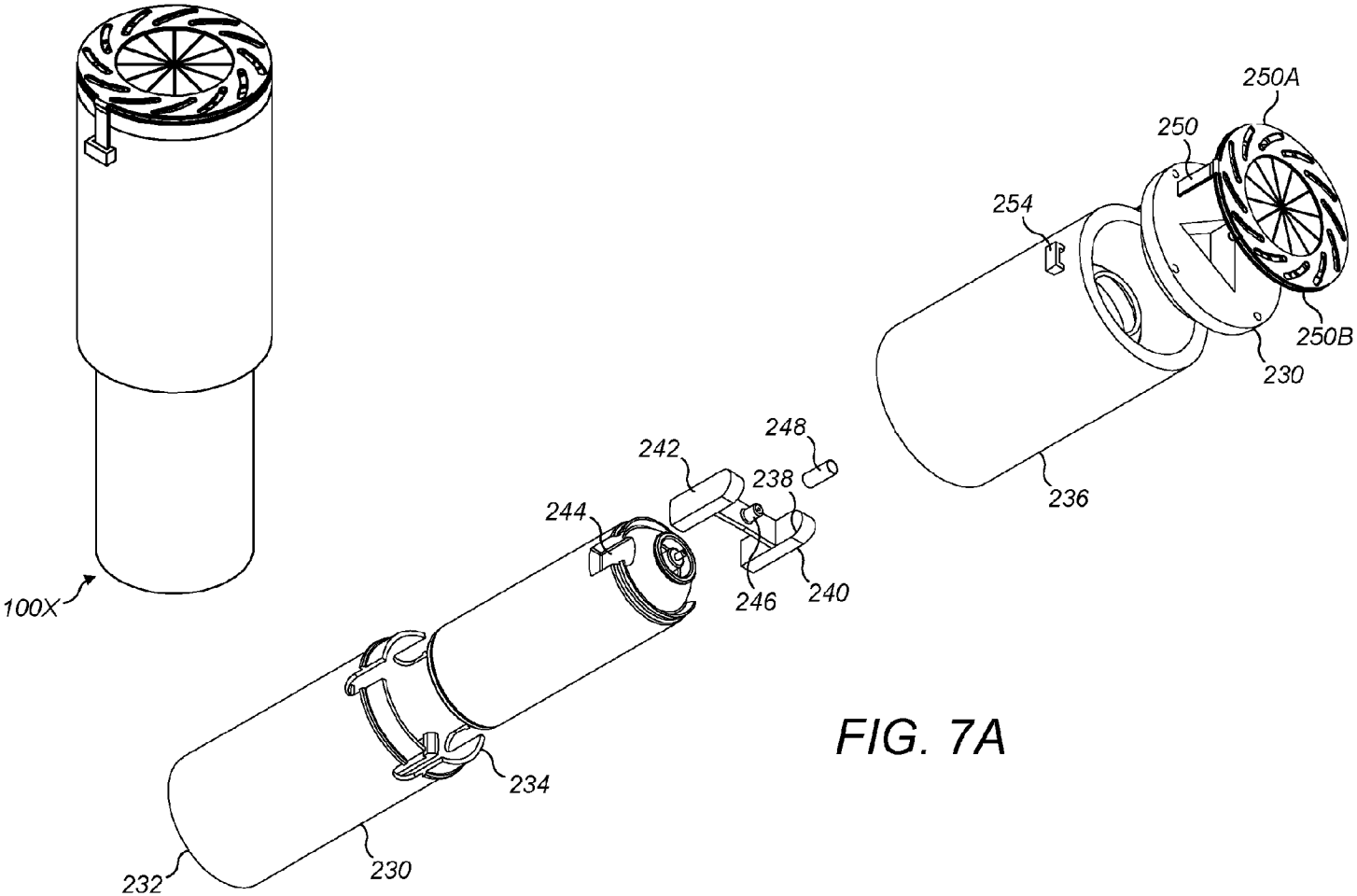
FIGS. 7A and 7B show a third embodiment of aerosol can assembly.
Figure 7B:
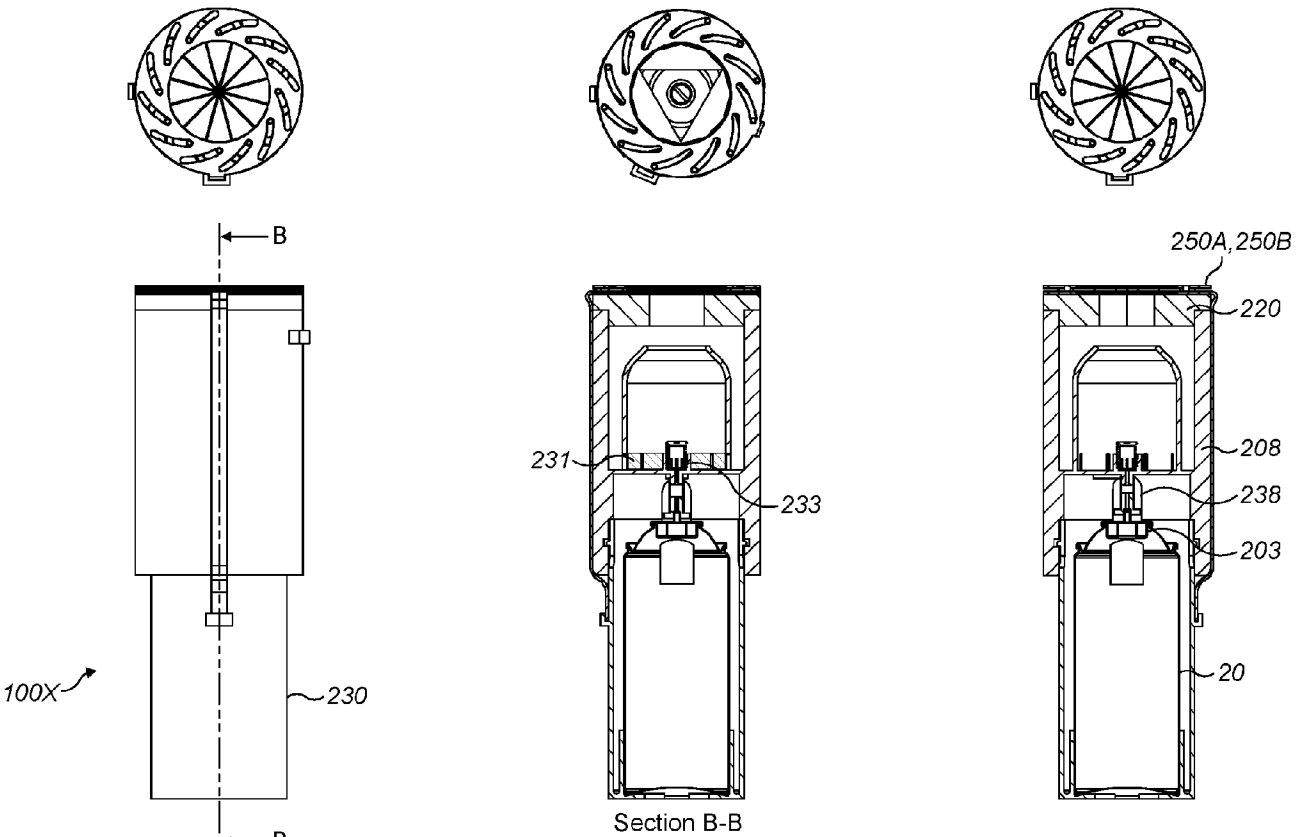

A third embodiment of aerosol assembly 100X is shown in FIGS. 7A and 7B. The assembly 100X is based on a modified version of the can 20 shown in FIG. 6. The can 20 in this embodiment is placed within a substantially cylindrical housing 230 with a first closed end 232 and a second open end 234. The base 23 of the can 20 rests on the closed end 232 of the housing 230. A cylindrically shaped lid 236 is operable to engage over the open end 234 of the housing 230 to encase the can 20. The cylindrically shaped lid has an inner diameter Ø1 which is greater than the outer diameter Ø2 of the cylindrical housing 230 so that the lid 236 can slide over the outer edge of the housing 230. The top of the cylindrically shaped lid 236 is open and receives the shape forming means 220.

The interior of the lid 230 is shown in the cross section views of FIG. 7B. The interior of the lid defines an inner chamber comprising a deck 231 for receiving liquid foam formulation 200. The middle of the deck comprises an inlet 233 for propellant 204 deriving from the can 20 as will be described.

A valve mechanism 250 is located on top of the shape forming means 220 to selectively cover the opening 222 thereof, and comprises two coaxial plates 250A;250B. In use, the coaxial plates twist with respect to each other between a first closed position as shown in FIG. 7A to a second open position as shown in FIG. 7B.

The lowermost plate 250A attaches to, and covers, the shape forming means 220. The second plate 250B comprises a downwardly extending leg 252 which connects to a bracket 254 located on the lid 236. In the first position, the two plates 250A;250B cooperate to block the opening 222 of the shape forming means 220. In the second position, the opening 222 is not blocked by the plates 250A;250B.

As shown in FIGS. 7A and 7B, the third embodiment of valve assembly comprises a bridging member 238 which extends over the opening of the can 20. The bridging member comprises two legs 240;242 which are slidably accommodated in corresponding recesses 244 in the can 20 for locating the bridging member 238 over the opening. The portion of the bridging member 238 which is located over the opening comprises a fluid duct 246 for actuating the valve portion 203. The bridging member 238 is movable along the recesses 244 from a first position whereby the legs 240;242 do not touch the bottom of the recesses 244 and where the fluid duct 246 does not actuate the valve, to a second lower position where the legs 240;242 touch the bottom of the recesses 244 and where the fluid duct 246 actuates the valve located in the valve portion 203.

To accommodate the downward movement of the bridging member 238 with respect to the lid 236, a sleeve 248 extends upwardly around the fluid duct 246. The sleeve 248 provides a channel for propellant 204 originating from the can 20, and fluidly connects with the inlet 233 located on the deck 231 of the lid 230.

The lid 236 is rotatable with respect to the housing 230 between a first position shown by the middle of the three drawings in FIG. 7B, to a second position shown by the rightmost drawing in FIG. 7B. In the first position, the two plates 250A;250B from the valve mechanism 250 are in their closed position. When the lid 236 is twisted to its second position as shown in FIG. 7B, a cam located on the inner surface of the lid 236 applies a downward force on the bridging member, pushing the bridging member down by approximately 2 mm to its second position. In this position, the fluid duct 246 of the bridging member 238 applies a downward force on to the valve portion 203 to open the valve.

Thus in the second position, propellant from the can 20 passes through the valve of the valve portion 230, through the fluid duct 246, the sleeve 248, and the inlet 233 into the inner chamber of the lid 230. From this chamber, the propellant contacts the foam formulation to form a foam which rises up through the inner chamber, through the opening 222 located in the shape forming means 220 and finally through the plates 250A;250B.

To close the assembly of FIG. 7, the lid 230 is twisted back to its first position, which places the plates 250A;250B into their closed position and which removes the camming force applied to the bridging member 238 so that the bridging member is restored to its initial, elevated, position inside the lid 230 by the resilient bias mechanism located in the valve portion 203.

Figure 8:
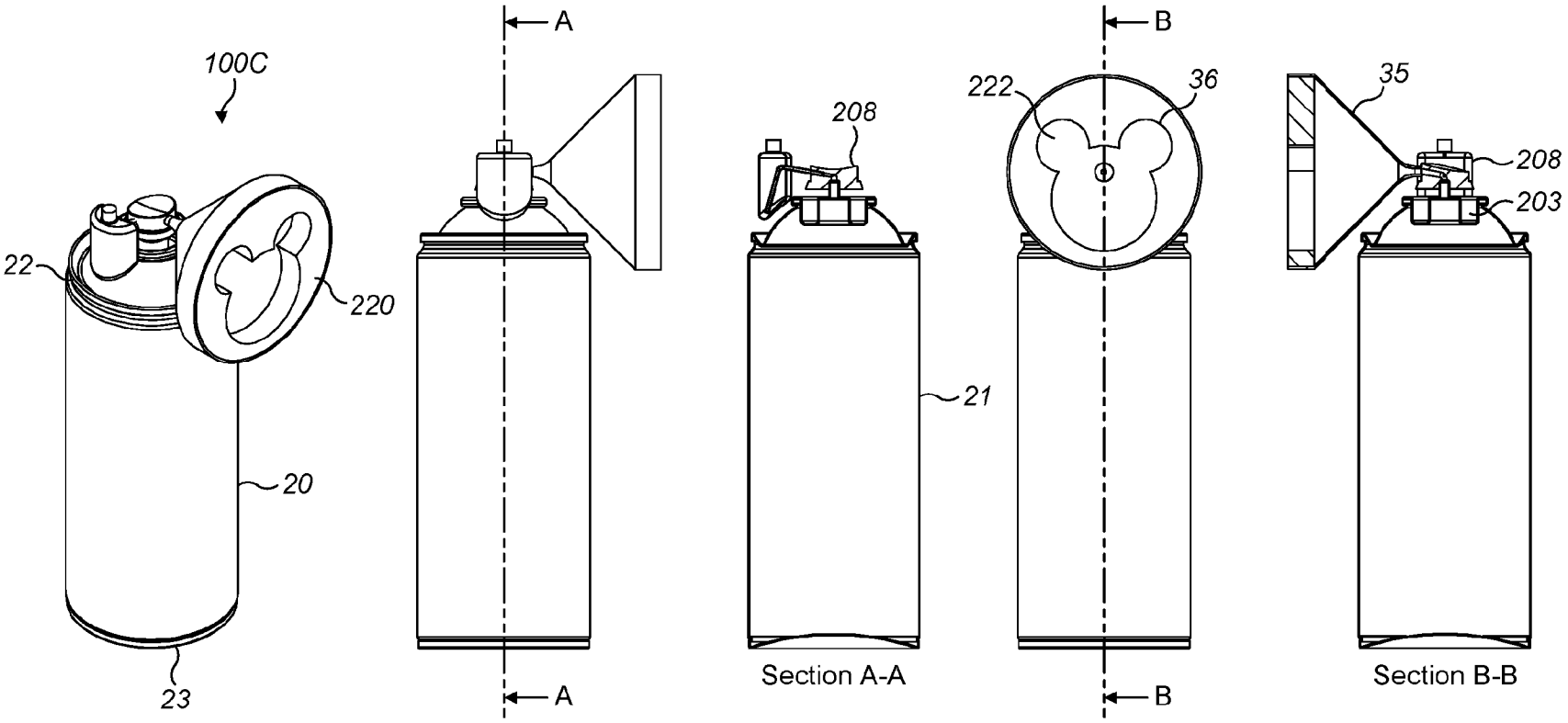
FIG. 8 shows a fourth embodiment of aerosol can assembly.

FIG. 8 shows a fourth embodiment of aerosol can assembly 100C. The fourth embodiment is very similar to that of the second embodiment shown in FIG. 6. In this fourth embodiment, the liquid foam formulation 200 is contained in a cartridge 224 attached to the actuator member, not in the interior volume of the can 20 (which can be seen from the cross section view B-B of FIG. 8 which shows no liquid in the can). In this embodiment, the liquid in the cartridge is fluidly connected to the internal passageway of the actuator member 208. When the actuator member is depressed, a Venturi force generated by the propellant from the can sucks liquid from the cartridge 224 into the actuator member 208, through the spout 35 of the nozzle 31 and out of the opening 222 located in the shape forming means 220.

Figure 9:
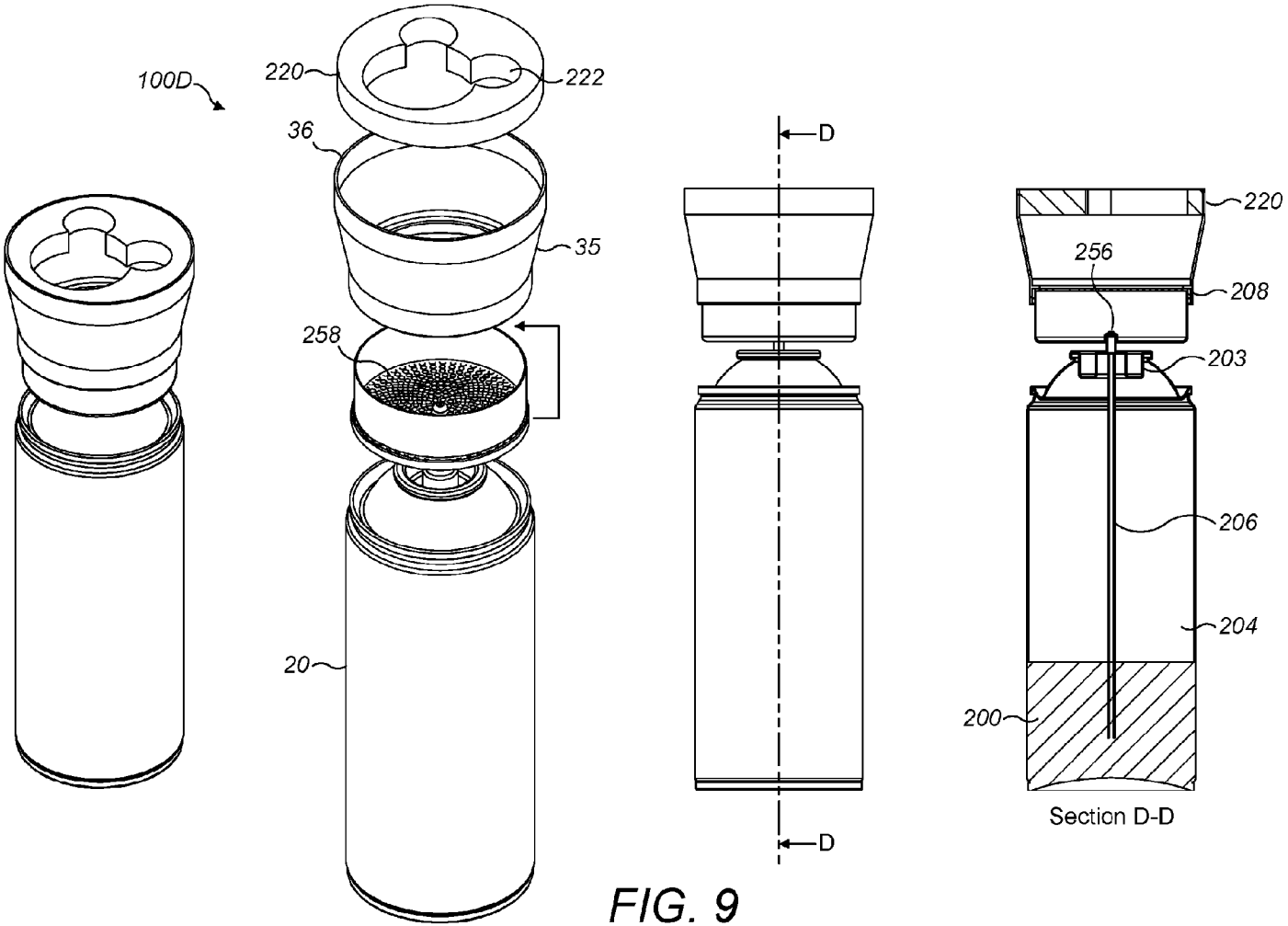
FIG. 9 shows a fifth embodiment of aerosol can assembly.

FIG. 9 shows a fifth embodiment of aerosol can assembly 100D. The can 20 of this embodiment is identical to that of the can 20 shown in FIG. 6. However the fifth embodiment includes an actuator member formed of a cylinder 208 closed at one end. The closed end of this cylinder 208 comprises a central opening portion 256 for engaging with the valve located in the valve portion 203. The opposing end of the cylinder 208 is open for receiving a mesh plate 258 comprising a plurality of small openings.

The opposing end of the cylinder 208 also connects to a nozzle 31 comprising a spout 35 which at its distal end has a nozzle opening 36. As with the embodiment shown in FIG. 6, the internal cross sectional area of the spout 35 is greater at the nozzle opening 36 than at its point of attachment to the actuator member, namely the cylinder 208. However, the spout 35 in this embodiment is substantially parallel with the elongate length of the can 20. As with the embodiment shown in FIG. 6, the nozzle opening 36 receives a shape forming means 220 in the form of a die containing an opening 222 with a particular cross section.

To operate the fifth embodiment, the cylinder 208 is pushed downward to actuate the valve in the valve portion 203. In so doing, liquid foam formulation from the reservoir inside the can 20 is forced through the valve and forms a thin film across the small openings in the mesh plate 238. The pressure from the propellant passing through the valve forces the liquid film across the small openings into a foam for dispensing through the spout 35 and the shape forming means 220.

Figure 10:
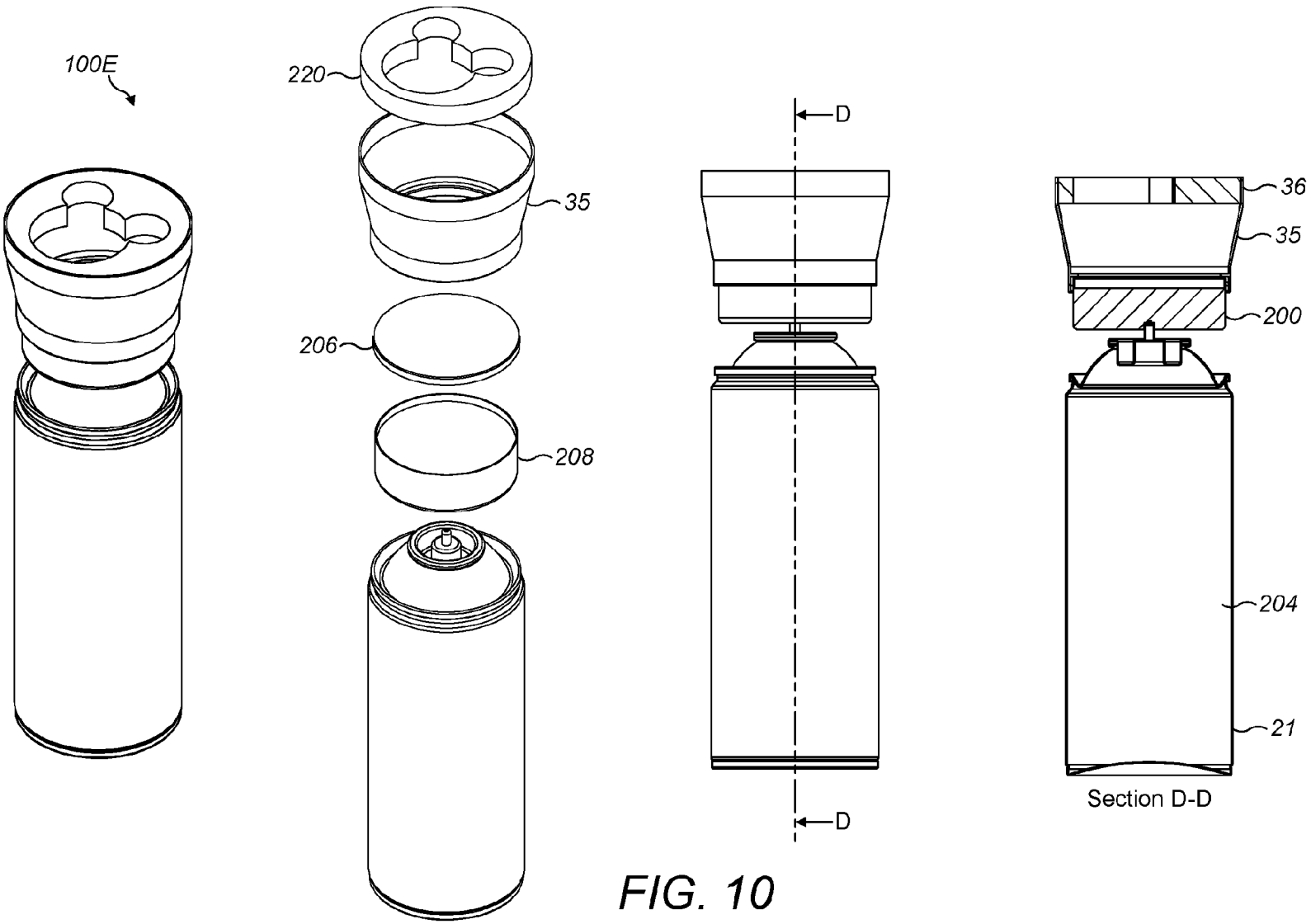
FIG. 10 shows a sixth embodiment of aerosol can assembly.

FIG. 10 shows a sixth embodiment of aerosol can assembly 100E. This embodiment is similar to the fifth embodiment shown in FIG. 9. However, the liquid foam formulation in the sixth embodiment is located in the cylinder 208. Additionally, the mesh plate 258 inside the cylinder is replaced with a porous material 260. In this embodiment, propellant inside the can 20 is forced through the valve. The pressure from the propellant passing through the valve forces the liquid in the cylinder 208 to soak into the material 260 and subsequently foam such that it dispenses through the spout 35 and the shape forming means 220.

Figure 11:
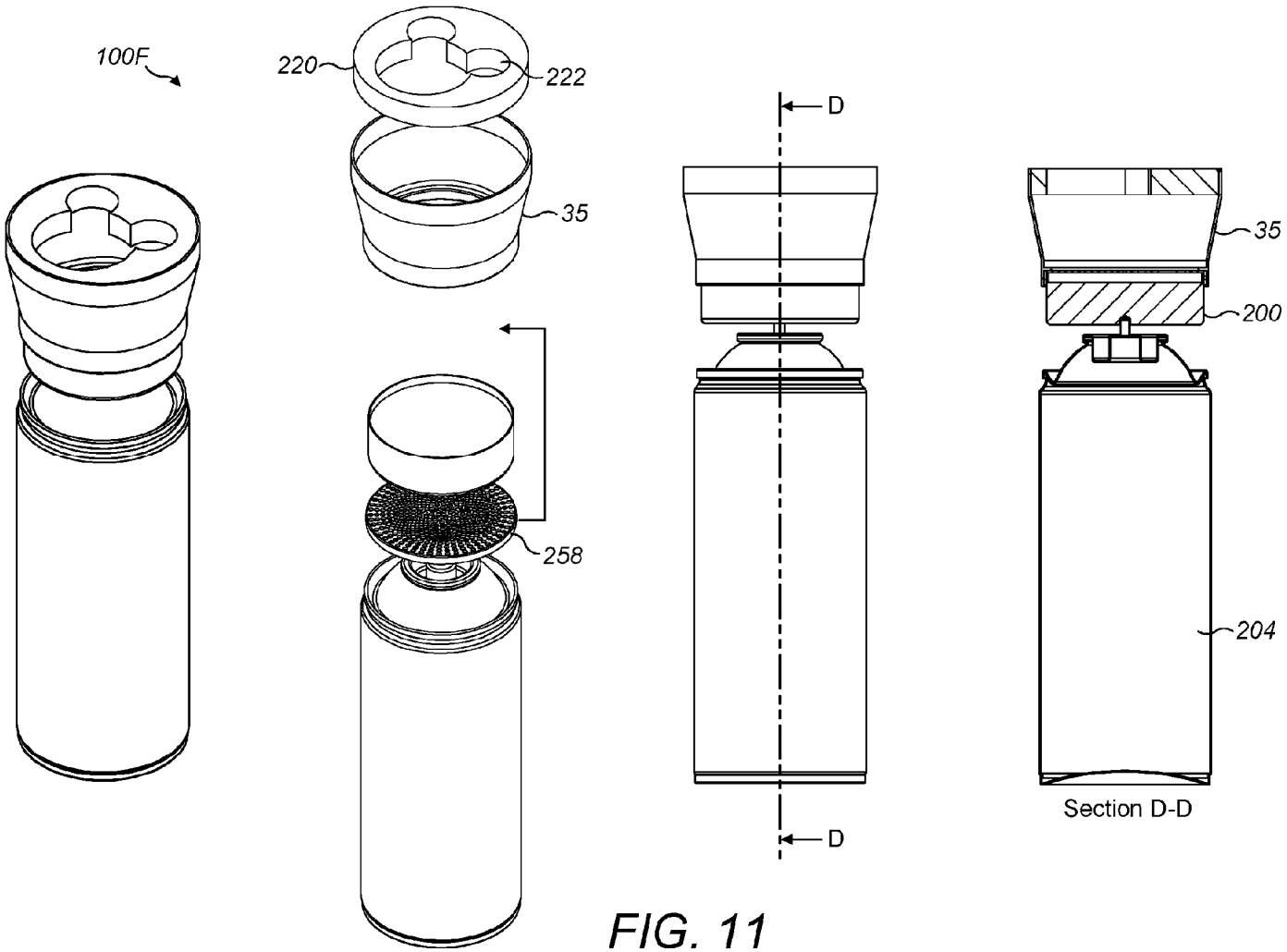
FIG. 11 shows a seventh embodiment of aerosol can assembly.

FIG. 11 shows a seventh embodiment of aerosol can assembly 100F. This embodiment is identical to the embodiment shown in FIG. 9 except for the liquid foam formulation being located in the cylinder 208 as per the embodiment shown in FIG. 10, and not in the can 20.

Figure 13:
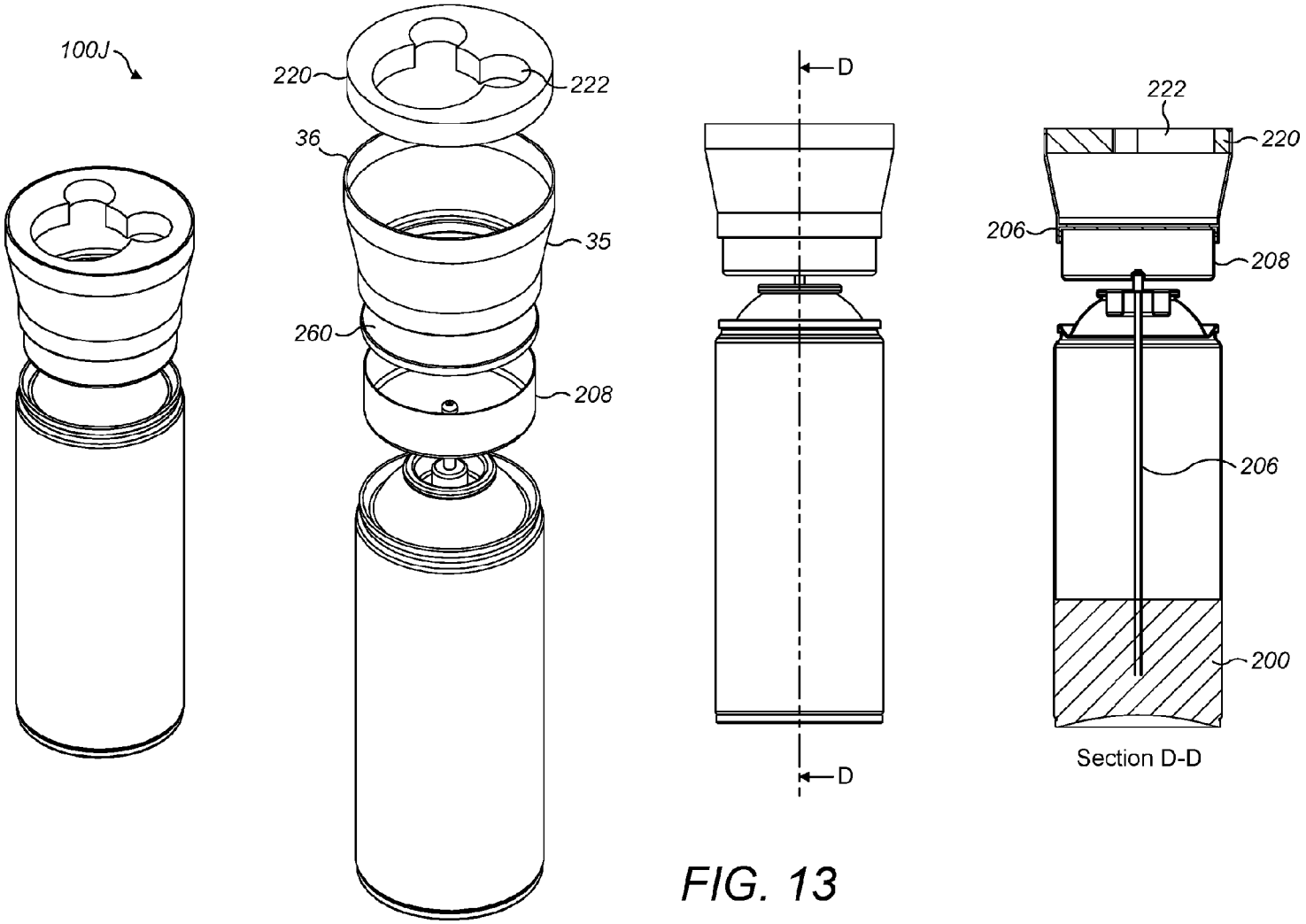
FIG. 13 shows a ninth embodiment of aerosol can assembly.

FIG. 13 shows a ninth embodiment of aerosol can assembly 100J. Operation of the ninth embodiment is identical to that of the fifth embodiment except that the mesh plate 258 inside the cylinder 208 is replaced with a porous material 260. In this embodiment, liquid foam formulation from the reservoir inside the can 20 is forced through the valve and is absorbed in the porous material 260. The pressure from the propellant passing through the valve forces the liquid in the material 260 to foam such that it dispenses through the spout 35 and the shape forming means 220.

Figure 14:
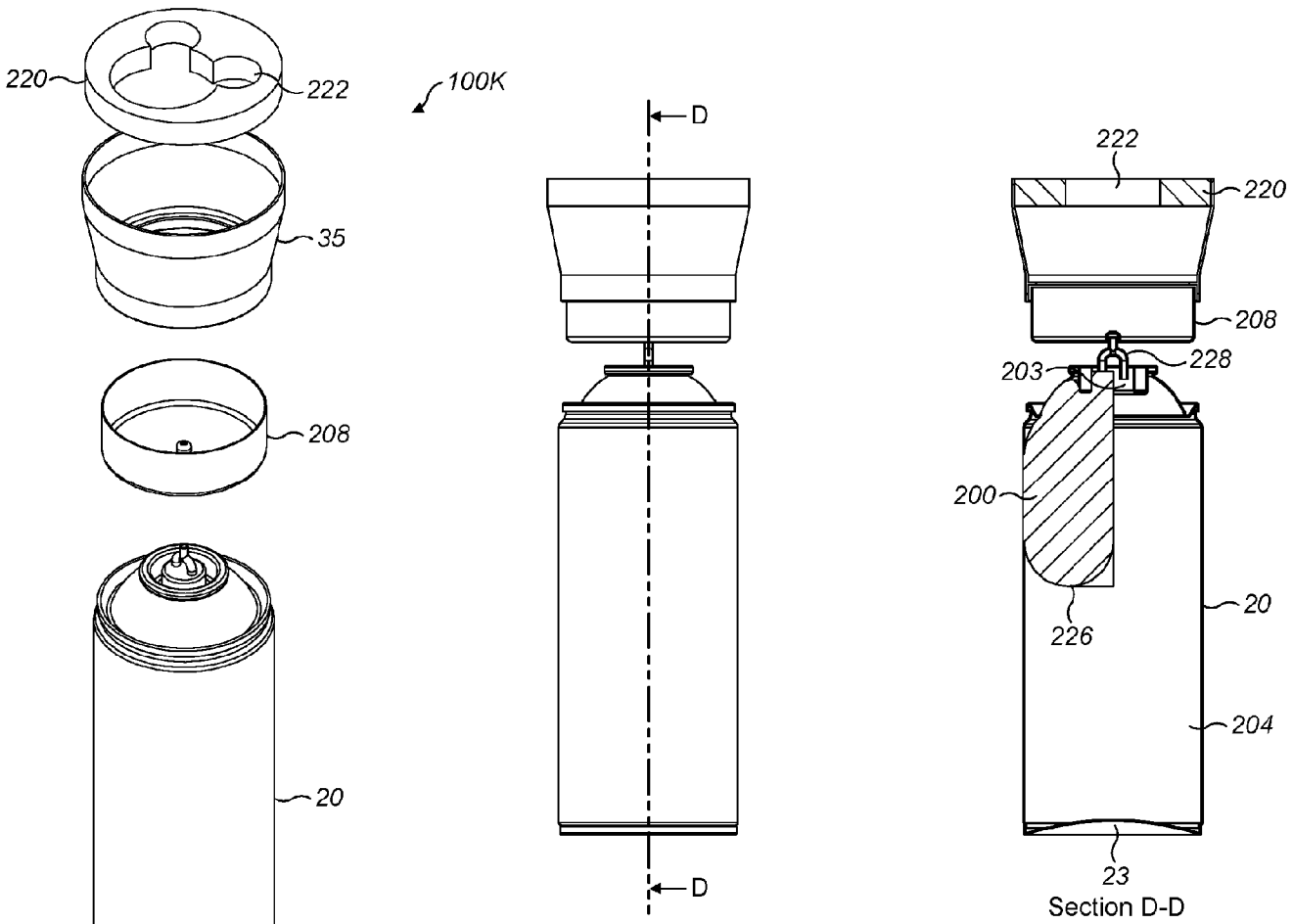
FIG. 14 shows a tenth embodiment of aerosol can assembly.
Figure 15:
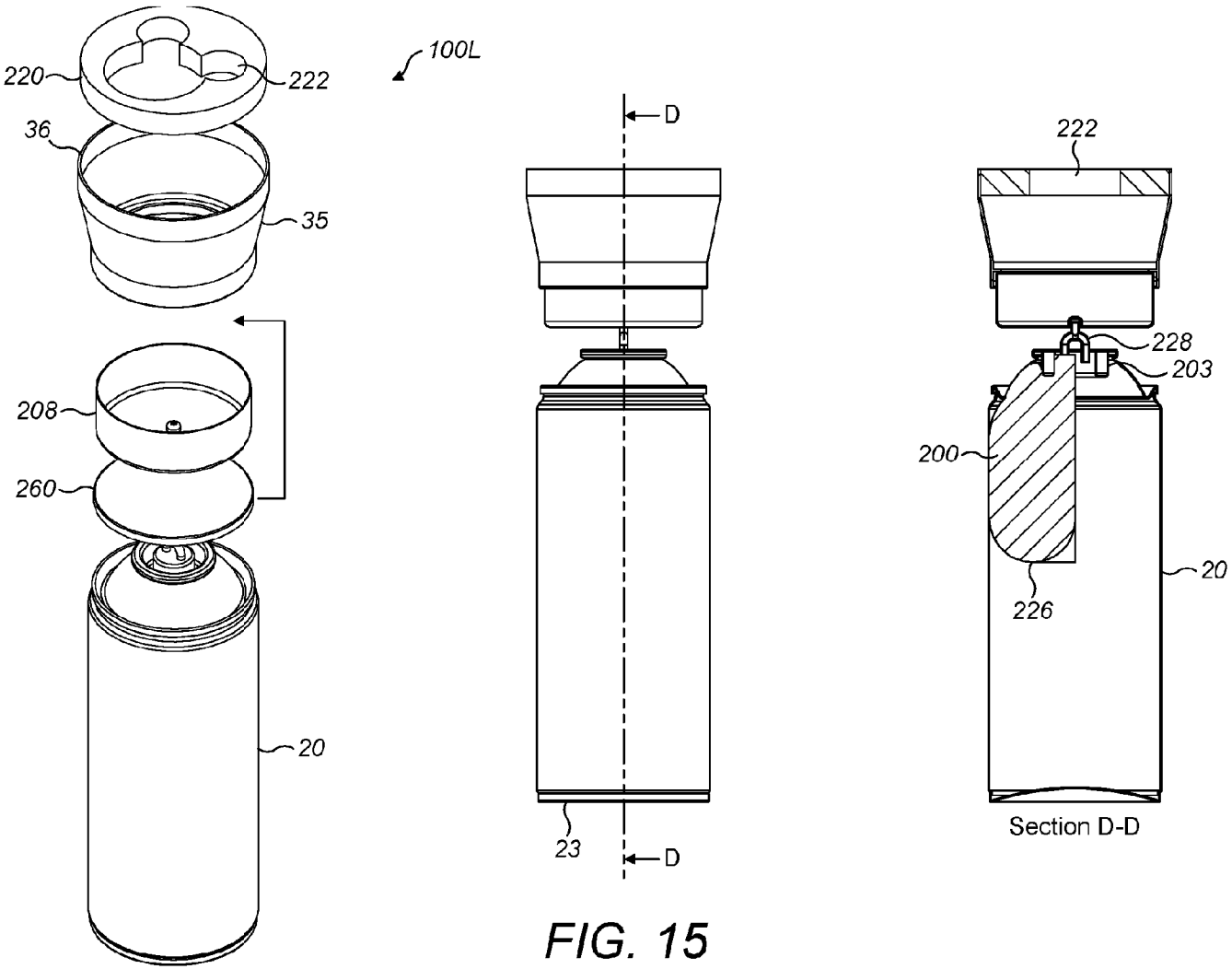
FIG. 15 shows an eleventh embodiment of aerosol can assembly.

FIG. 14 shows a tenth embodiment of aerosol can assembly 100K which is similar to the embodiment shown in FIG. 9. In this embodiment, the liquid foam formulation 200 is contained within a bag 226 inside the can 20. The bag 226 fluidly isolates the liquid foam formulation 200 from the propellant 204 located in the remaining interior apace of the can 20. The valve portion 203 in this embodiment comprises a Y shaped channel 228. One arm of the channel is fluidly connected to the liquid foam formulation 200 contained within the bag 226. The other arm of the Y shaped channel fluidly connects with the propellant 204 located in the remaining interior space of the can 20. In use of the assembly 100K, when the actuator member 208 is depressed, the valve (not shown) located in the valve portion 203 opens both the arms of the Y shaped channel allowing both the propellant and foam formulation to mix and foam out through the assembly through the spout 35 of the nozzle 31 and out of the opening 222 located in the shape forming means 220.

In this embodiment, there is no mesh plate 258 or porous material 260 inside the cylinder 208 since the mixing of the foam formulation and the propellant inside the Y shaped channel is sufficient to generate foaming without the need for either the mesh plate 258 or porous material 260. The can assembly could however additionally include a porous material 260 located in the cylinder 208, as shown in the embodiment 100L of FIG. 15, or a mesh plate 258 located in the cylinder 208 as shown in the embodiment 100P of FIG. 18, to further assist with the foam generation.

Figure 16:
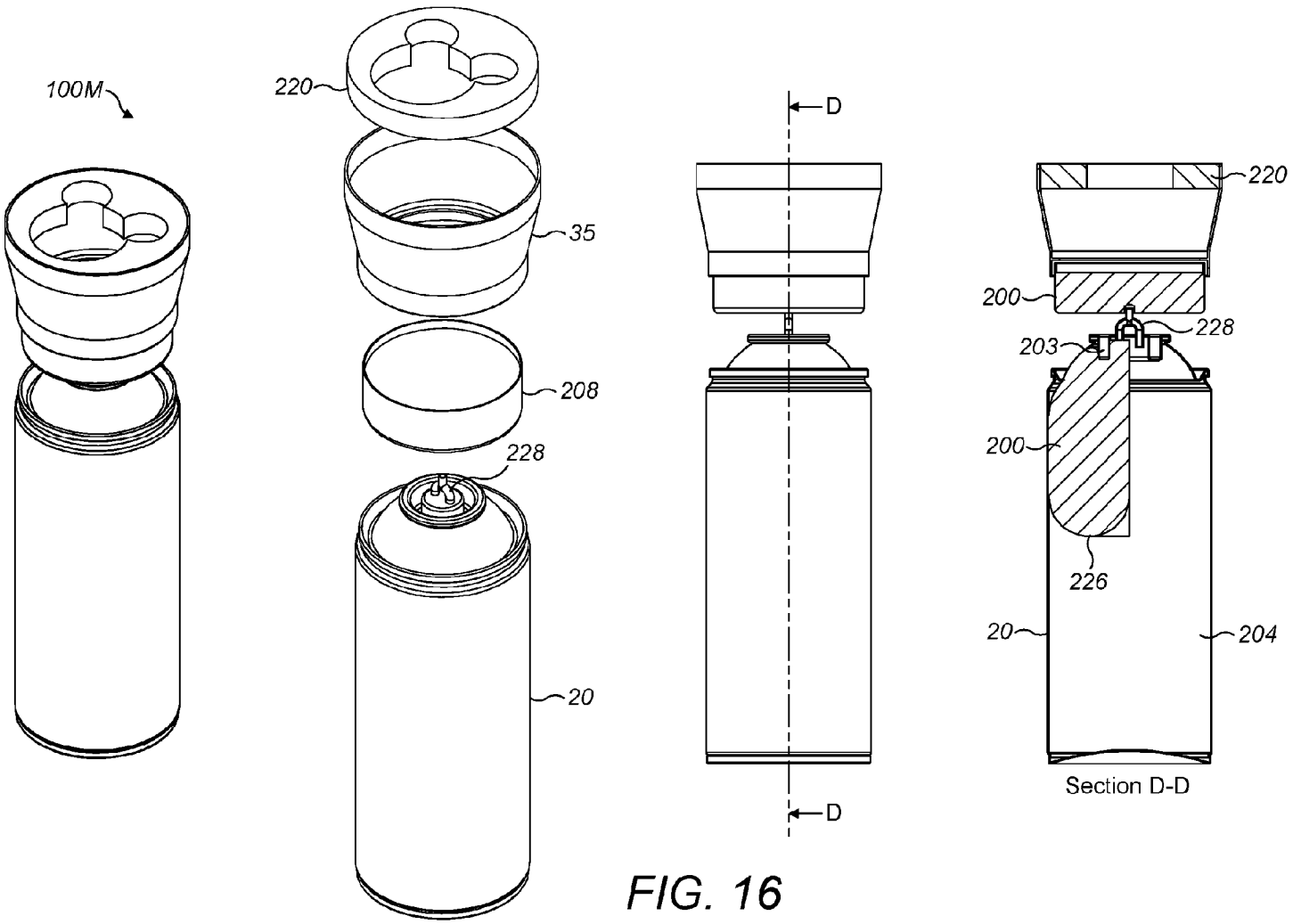
FIG. 16 shows a twelfth embodiment of aerosol can assembly.

FIG. 14 could further be modified into a different embodiment 100M, as per FIG. 16, wherein the cylinder 208 comprises an additional liquid foam formulation to the foam formulation contained in the bag 226. With this embodiment, the two portions of foam formulation mix when the valve in the valve portion 203 is actuated by the cylinder 208. In this embodiment, one of the two liquid foam formulations could be replaced with another liquid, for instance a different foam formulation, or a colouring solution so that foams of different colours can be generated by the assembly.

Figure 19:
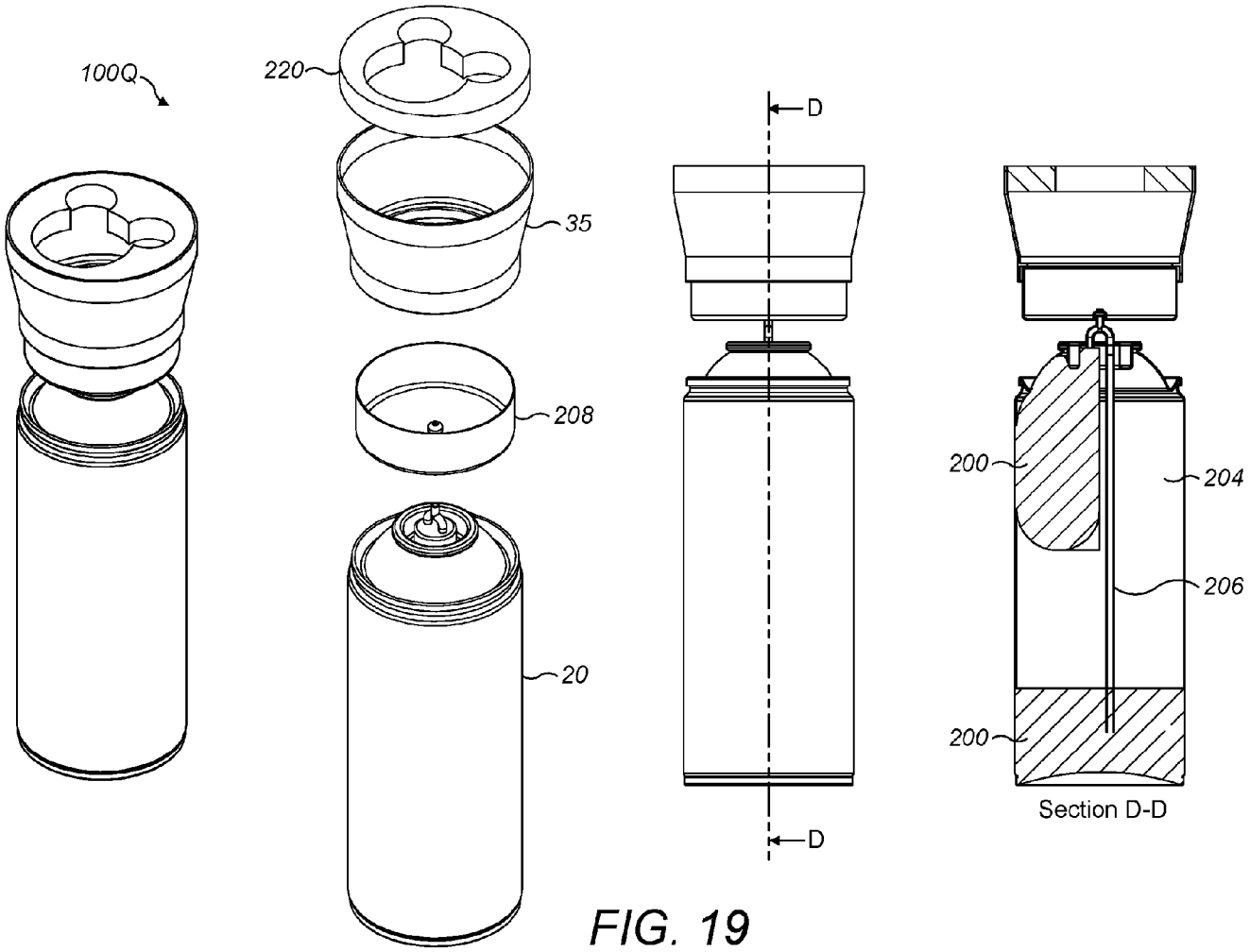
FIG. 19 shows a fifteenth embodiment of aerosol can assembly.

The assembly shown in FIG. 14 could be modified to additionally include further liquid foam formulation 200 in the can 20, which is located outside of the bag 226, as per the embodiment 100Q shown in FIG. 19. A tube 206 in this embodiment extends from the arm of the Y shaped channel 228 not fluidly connected to the bag 226 and extends downwardly into the interior volume of the can 20 and into the liquid foam formulation 200 located in the bottom of the can 20. With this embodiment, the two portions of foam formulation will mix when the valve in the valve portion 203 is actuated by the cylinder 208.

Figure 17:
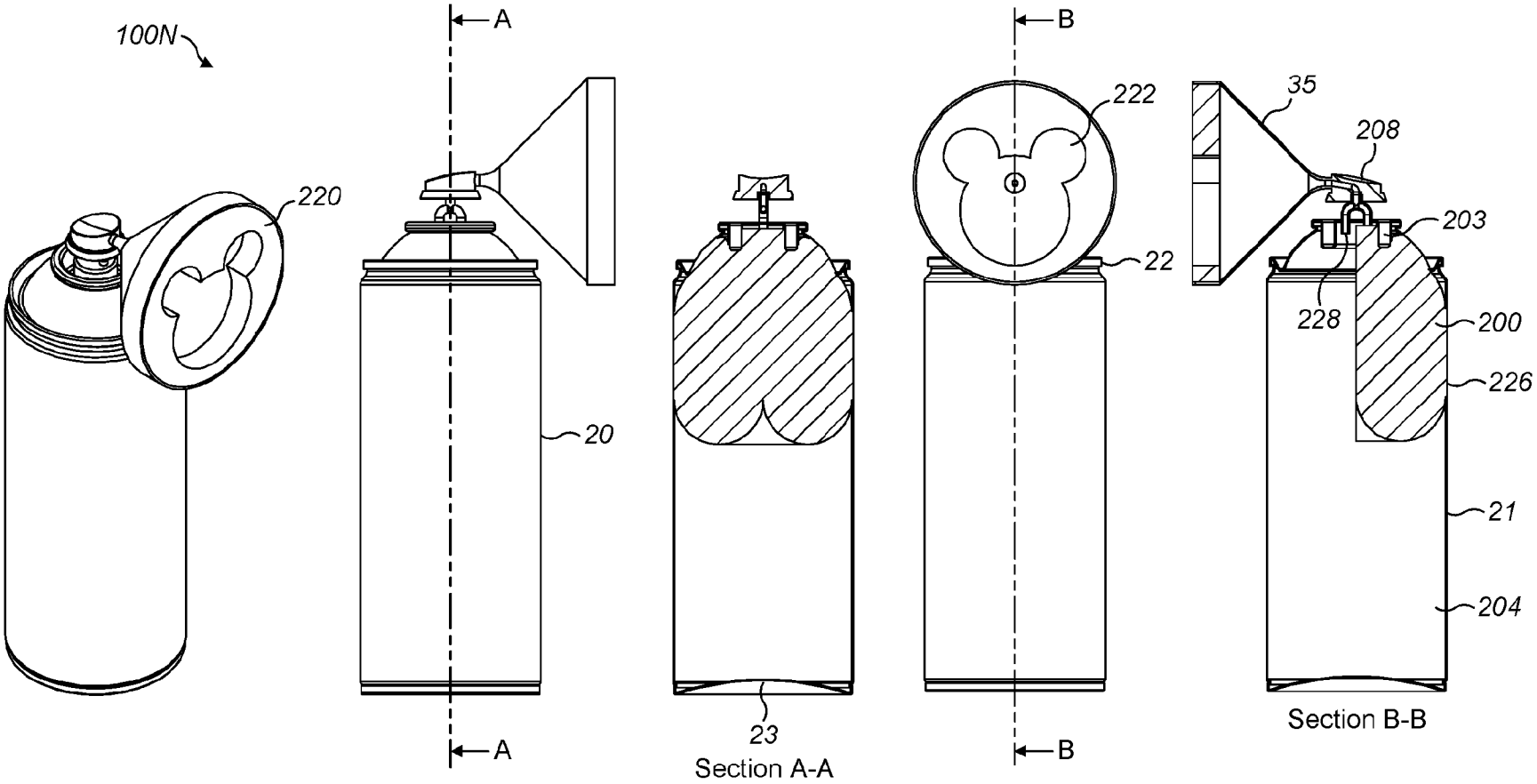
FIG. 17 shows a thirteenth embodiment of aerosol can assembly.
Figure 18:
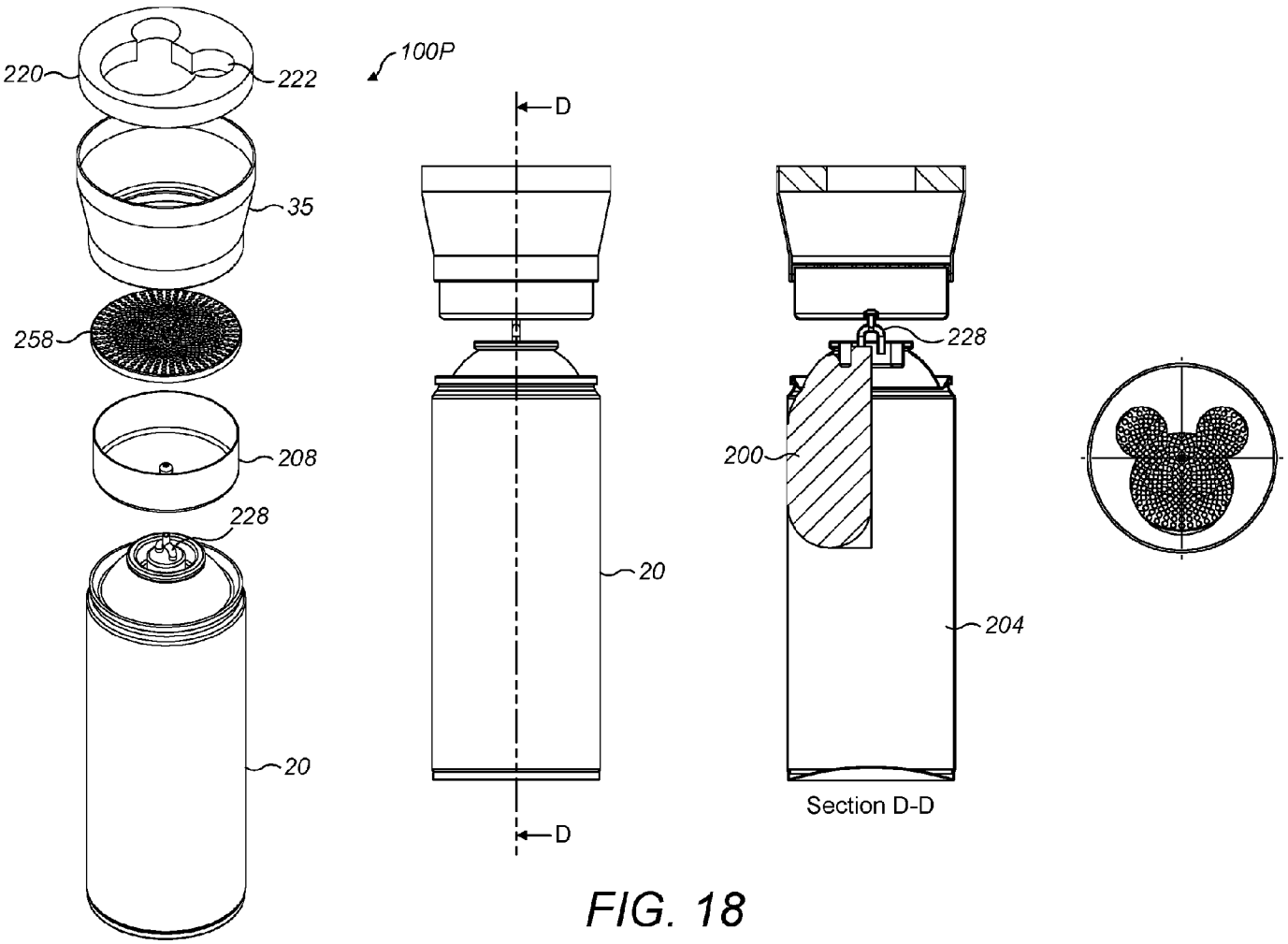
FIG. 18 shows a fourteenth embodiment of aerosol can assembly.

FIG. 17 shows a thirteenth embodiment of aerosol can assembly 100N. The thirteenth embodiment is very similar to that of the second embodiment shown in FIG. 6. The difference is that the liquid foam formulation 200 is contained within a bag 226 inside the can 20. As discussed in the tenth embodiment shown in FIG. 14, the bag 226 fluidly isolates the liquid foam formulation 200 from the propellant 204 located in the remaining interior apace of the can 20. The valve portion 203 in this embodiment comprises a Y shaped channel 228. One arm of the channel is fluidly connects with the liquid foam formulation 200 contained within the bag 226. The other arm of the Y shaped channel fluidly connects with the propellant 204 located in the remaining interior apace of the can 20. In use of the assembly 100N, when the actuator member 208 is depressed, the valve (not shown) located in the valve portion 203 opens both the arms of the channels allowing both the propellant and foam formulation to mix and pass out through the assembly through the spout 35 of the nozzle 31 and out of the opening 222 located in the shape forming means 220.

Although the above aerosol assemblies are described as being in the form of can, it will be appreciated that the assemblies could comprise a container suitable for storing the foam formulation and propellant which is not necessarily a can. For example, rather than a can, the container could be plastic based to allow the container to be moulded into any required shape. Suitable plastics for such a container include, but are not limited to, at least one of: high impact polystyrene; thermoplastic elastomers; polyethylene terephthalate, polyester terephthalate glycol; and high-density polyethylene.

Figure 20:
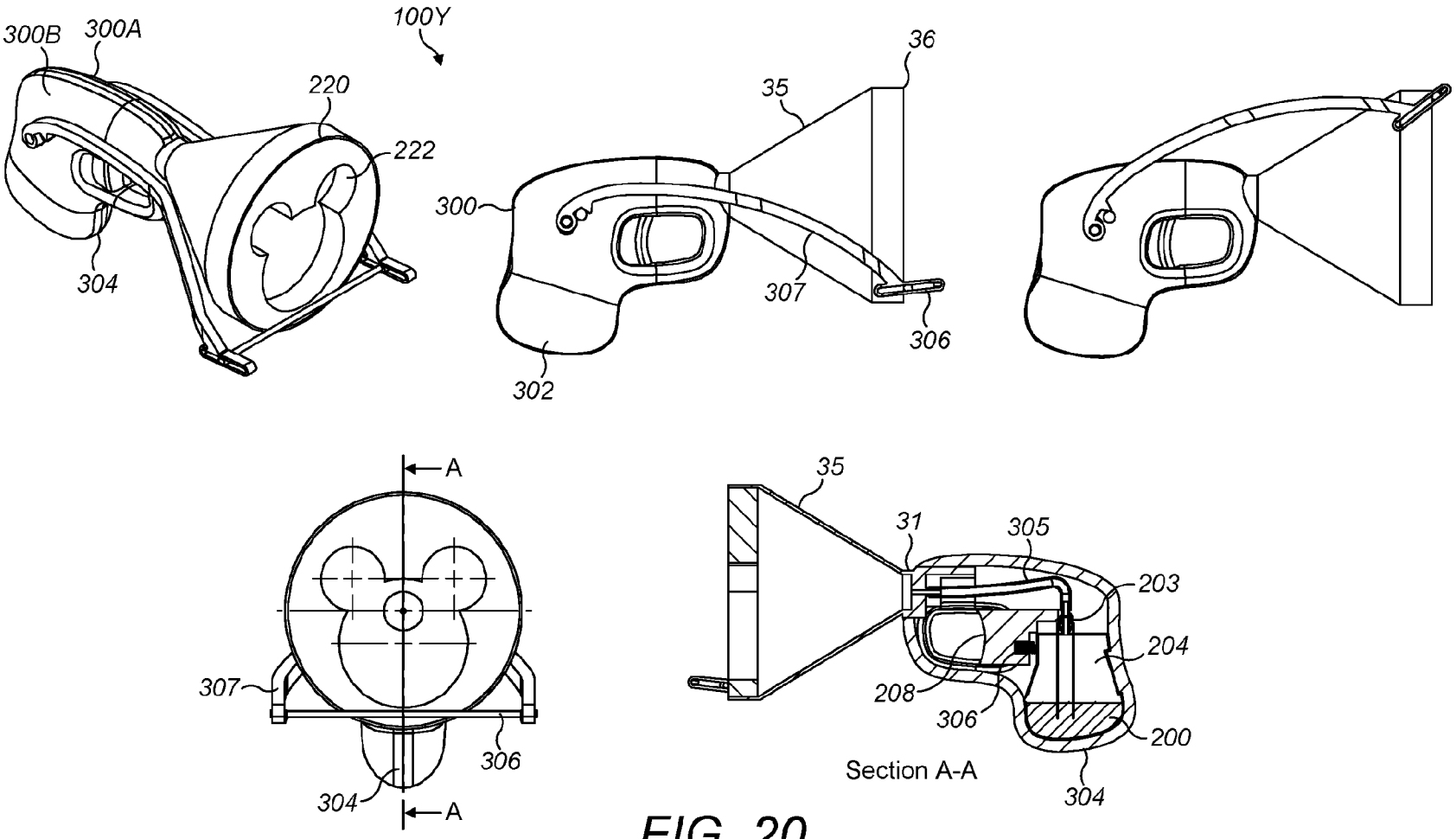
FIG. 20 shows a further embodiment of aerosol assembly.

FIG. 20 shows such an aerosol assembly 100Y. In this embodiment, the assembly 100Y is formed of a main body 300 in the shape of a pistol. The main body is formed of two shell portions 300A;300B which are injection moulded and adhered together. The pistol shaped body 300 comprises a handle 301 which defines an interior cavity for receiving a detachable cartridge 304 which contains a reservoir of liquid foam formulation 200 and propellant 204. The cartridge further comprises a valve portion 203 containing a valve for selectively controlling the escape of the liquid foam formulation 200 and propellant 204 from the cartridge 304.

The body 300 of the assembly 100Y is releasably connected to a nozzle 31 which comprises a spout 35 terminating in a nozzle opening 36. The internal cross sectional area of the nozzle 31 is greater at the nozzle opening 36 than at its point of attachment to the body 300. The nozzle opening 36 receives a shape forming means 220 containing an opening 222 with a particular cross section as in the previous embodiments.

The nozzle 31 is also fluidly connected to a deformable tube 305 in the body 300 defining an internal passageway that directs foam formulation and propellant from the reservoir of the cartridge 304 to the nozzle 31.

An annular opening within the pistol shaped body 300 comprises a depressible trigger 208 which acts as the actuator member to control the operation of the assembly 100Y as will be described. A resilient bias mechanism, shown in FIG. 20 as a spring 306 inside the body 300, biases the trigger 208 to its undepressed position.

A cutting blade 306 for sweeping across the opening 222 of the shape forming means 220 is pivotally attached to the main body 300 by a pair of attachment arms 307. The blade 306 is pivotally mounted to each of the attachment arms 307 and is actuated by the trigger 208.

To operate the assembly 100Y shown in FIG. 20, the cartridge 304 is first inserted inside the cavity of the handle 301. The trigger 208 is then partially depressed causing it to impinge and actuate the valve located on the cartridge 304, allowing the liquid foam formulation contained therein to pass out through the assembly through the spout 35 of the nozzle 31 and out of the opening 222 located in the shape forming means 220.

Further depression of the trigger 208 actuates the pair of attachment arms 307 and causes them to rotate upwardly in relation to the body 300, which causes the cutting blade 306 to sweep across the opening 222 of the shape forming means 220 to sever any foam emitted therefrom.

When the trigger 208 is released, the biasing force provided by the spring 306 inside the body 300 returns the trigger 208 to its undepressed position. In so doing, the valve on the cartridge 304 is closed and the attachment arms 307 revert to their original positions.

It will thus be appreciated that the trigger 208 acts in two stages; a first stage for generating a shaped foam; and a second stage for severing the generated foam from the assembly 100Y.

In an alternative operation, the trigger could be designed such that when it is depressed, the cutting blade 306 initially sweeps across the opening 222 of the shape forming means before any foam is emitted therefrom. When the trigger is then released, the cutting blade 306 then sweeps back to its initial position to sever any foam emitted from the shape forming means 220.

Figure 21:
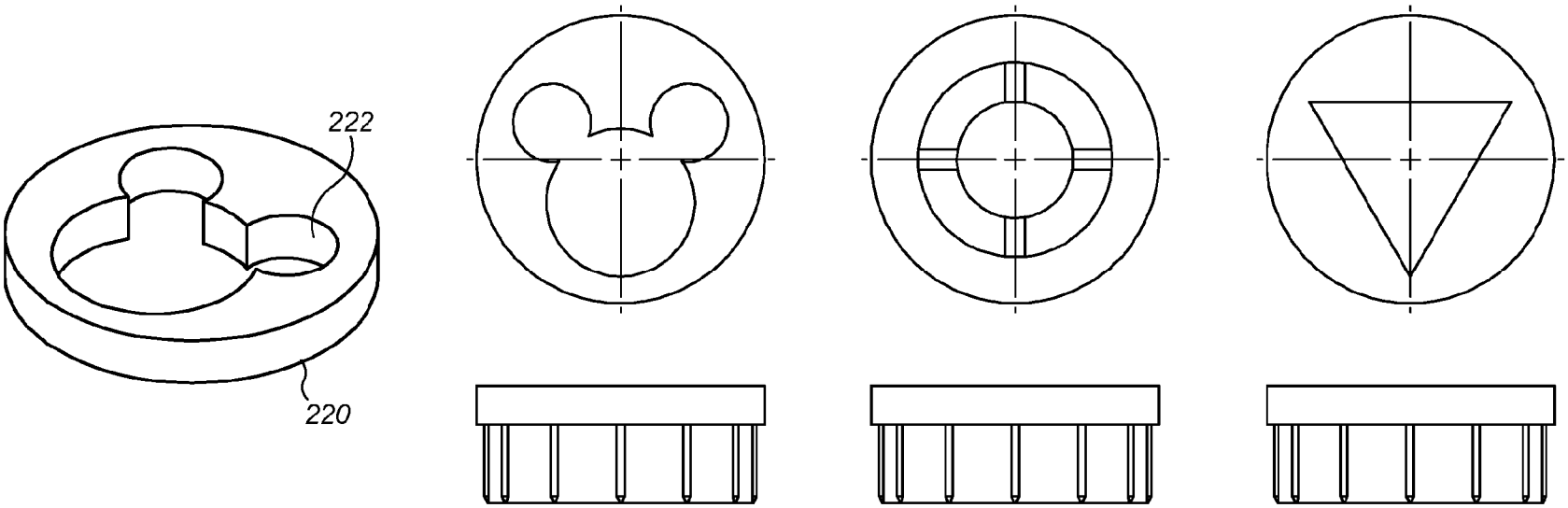
FIG. 21 shows various shape forming means with differently shaped openings for use with the assemblies according to the embodiments shown in FIGS. 6-20.

The shape forming means 220 of the embodiments from FIGS. 6-20 is interchangeable with other shape forming means 220 which have openings of varying cross section. FIG. 21 shows an array of such shape forming means 220 each with a different shape of opening for the foam. In particular, FIG. 21 shows three different shape forming means, one with a mouse head shaped opening (as in FIG. 6); one with an annular shaped opening; and one with a triangular shaped opening. It will be appreciated that other opening shapes are possible.

The foam formulation of the present invention is further described by way of example.

EXAMPLE 1

An aerosol can was filled with foam formulations a or b and a propellant mixture of 30% helium and 70% oxygen. When the actuator part of the aerosol can was depressed, foam was dispensed which floated up in air due to its low density.

| Foam formulation a | |
|---|---|
| Water | 79.45% |
| Disodium cocoamphodipropionate | 10% |
| Copolymer of acrylamide and diallyldimethylammonium chloride | 10% |
| Perfume | 0.3% |
| Methylisothiazolinone 3-iodo-2-propynyl butyl carbamate | 0.1% |
| Phenoxyethanol | |
| Propylene glycol | |
| PEG-40 hydrogenated castor oil | 0.1% |
| Disodium EDTA | 0.05% |

| Foam formulation b | |
|---|---|
| Water | 72% |
| Sodium laureth sulphate | 14% |
| Cocoamidopropyl betaine | 4% |
| Glycerin | 4% |
| Cocoamide DEA | 2% |
| Sodium chloride | 1.4% |
| Polyquatermium-7 | 1% |
| PEG-7 glyceryl cocoate | 0.5% |
| Propylene glycol | 0.5% |
| Perfume | 0.3% |
| Phenoxyethanol | 0.3% |

The invention claimed is:

1. An aerosol assembly for dispensing a foam which floats in air, wherein the aerosol assembly comprises:

a body;

a first reservoir located in the body and containing a propellant which is suitable for forming the foam, and a second reservoir located outside of the body and containing a foam formulation, each reservoir fluidly connected to an outlet;

a valve mounted to the body and actuatable to open and close the outlet;

a nozzle defining a passageway located between the valve and a shape forming member; and an actuator member for actuating the valve;

wherein the actuator member is arranged to move relative to the body such that:

in a first position the valve is closed; and as the actuator member moves towards a second position the valve is opened;

wherein the shape forming member imparts a cross-sectional shape to the foam as the foam is ejected from the nozzle;

wherein the foam is formed outside of the body;

wherein the aerosol assembly is a handheld aerosol assembly; and wherein the propellant is dispensed from a single reservoir.

2. An aerosol assembly according to claim 1, wherein the actuator member comprises a cylinder which forms the second reservoir.

3. An aerosol assembly according to claim 1, wherein the shape forming member comprises a die having a die opening.

4. An aerosol assembly according to claim 1, wherein the shape forming member is formed integrally with the nozzle.

5. An aerosol assembly according to claim 1, wherein the shape of the shape forming member is not circular.

6. An aerosol assembly according to claim 1, comprising a second valve mounted to the body and actuatable to prevent foam passing through the shape forming member from escaping the aerosol assembly.

7. An aerosol assembly according to claim 1, wherein the aerosol assembly is an aerosol can assembly.

8. An aerosol assembly according to claim 1, further comprising a cutting member actuatable by the actuator member, wherein as the actuator moves between the first position and the second position the cutting member slides adjacent to and across the shape forming member.

9. An aerosol assembly according to claim 1, wherein the foam formulation is a soap formulation.

10. An aerosol assembly according to claim 1, wherein the foam has a density lower than that of air.

11. An aerosol assembly according to claim 1, wherein the density of the foam is less than 1.14 $kgm^{-3}$.

12. An aerosol assembly according to claim 1 wherein the propellant is helium, a helium/oxygen mixture, a helium/nitrogen mixture, hydrogen, a hydrogen/oxygen mixture, or a hydrogen/nitrogen mixture.

13. An aerosol assembly according to claim 1, wherein the aerosol assembly is suitable for domestic use.

14. An aerosol assembly according to claim 1, wherein the propellant comprises helium.

15. An aerosol assembly according to claim 1, wherein the propellant comprises a gas or mixture of gases that has a density less than that of air.

16. An aerosol assembly according to claim 1, wherein the second reservoir is located directly above the body.

17. An aerosol assembly according to claim 1, wherein the second reservoir is located adjacent to the body.

* * * * *